US008346138B2

(12) United States Patent
Sugitani et al.

(10) Patent No.: US 8,346,138 B2
(45) Date of Patent: Jan. 1, 2013

(54) INTERMEDIATE TRANSFER UNIT, TRANSFER DEVICE AND IMAGE FORMING APPARATUS

(75) Inventors: Kazutoshi Sugitani, Kanagawa (JP); Kiyotoshi Kaneyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 461 days.

(21) Appl. No.: 12/760,107

(22) Filed: Apr. 14, 2010

(65) Prior Publication Data

US 2010/0284708 A1 Nov. 11, 2010

(30) Foreign Application Priority Data

Apr. 14, 2009 (JP) ..... P2009-098010

(51) Int. Cl.
*G03G 15/01* (2006.01)

(52) U.S. Cl. ..... 399/299; 399/54; 399/66; 399/121; 399/302

(58) Field of Classification Search ..... 399/53, 399/54, 66, 121, 298–300, 302, 303
See application file for complete search history.

(56) References Cited

U.S. PATENT DOCUMENTS

| | | | | |
|---|---|---|---|---|
| 6,934,497 | B2 * | 8/2005 | Hagiwara et al. | 399/299 |
| 7,054,585 | B2 * | 5/2006 | Sasamoto et al. | 399/299 |
| 7,726,796 | B2 | 6/2010 | Takahashi et al. | |
| 2008/0317518 | A1 * | 12/2008 | Fukuhara | 399/302 |

FOREIGN PATENT DOCUMENTS

| | | | |
|---|---|---|---|
| JP | 2005-338424 | A | 12/2005 |
| JP | 2006-256124 | A | 9/2006 |
| JP | 2007-033779 | A | 2/2007 |

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

An intermediate transfer unit includes first to third movement controllers. When a first image carrier is used, the first movement controller moves a first moving member to a first position. When the first image carrier is not used, the first movement controller moves the first moving member to a second position. When second image carriers are used, the third movement controller moves a third moving member to a fifth position. When the second image carriers are not used, the third movement controller moves the third moving member to a sixth position. When any of the first and second image carriers is used, the second movement controller moves a second moving member to a third position. When the first and second image carriers are not used, the second movement controller moves the second moving member to a fourth position.

9 Claims, 13 Drawing Sheets

POSTURE SETTING TABLE TB

| | POSITIONS OF RETRACT ROLLS | | | | |
|---|---|---|---|---|---|
| NO | R5 | R4 | R3 | R2 | R1 |
| 1 | UP | UP | UP | UP | UP |
| 2 | UP | UP | UP | DOWN | UP |
| 3 | UP | UP | UP | UP | DOWN |
| 4 | UP | UP | UP | DOWN | DOWN |
| 5 | DOWN | UP | UP | DOWN | UP |
| 6 | DOWN | UP | UP | UP | DOWN |
| 7 | DOWN | UP | UP | DOWN | DOWN |
| 8 | DOWN | DOWN | DOWN | UP | UP |
| 9 | UP | UP | DOWN | DOWN | UP |
| 10 | UP | UP | DOWN | UP | DOWN |
| 11 | DOWN | DOWN | DOWN | DOWN | UP |
| 12 | DOWN | DOWN | DOWN | UP | DOWN |
| 13 | UP | UP | DOWN | DOWN | DOWN |
| 14 | DOWN | DOWN | DOWN | DOWN | DOWN |

FIG. 5

101

| | NO. | NUMBER OF COLORS | IMAGE FORMATION COLORS | | | |
|---|---|---|---|---|---|---|
| | | | K (BLACK) | CMY (CYAN, MAGENTA, AND YELLOW) | O (ORANGE) | G (GREEN) |
| | ☑ 1 | SIX COLORS | ○ | ○ | ○ | ○ |
| 101a | ☐ 2 | FIVE COLORS | ○ | ○ | | ○ |
| | ☐ 3 | FIVE COLORS | ○ | ○ | ○ | |
| | ☐ 4 | FOUR COLORS | ○ | ○ | | |
| 101a | ☐ 5 | FOUR COLORS | | ○ | | ○ |
| | ☐ 6 | FOUR COLORS | | ○ | ○ | |
| | ☐ 7 | THREE COLORS | | ○ | | |
| 101a | ☐ 8 | TWO COLORS | | | ○ | ○ |
| | ☐ 9 | TWO COLORS | ○ | | | ○ |
| | ☐ 10 | TWO COLORS | ○ | | ○ | |
| 101a | ☐ 11 | ONE COLOR | | | | ○ |
| | ☐ 12 | ONE COLOR | | | ○ | |
| | ☐ 13 | ONE COLOR | ○ | | | |
| 101a | ☐ 14 | ZERO COLOR | | | | |

FIG. 6

POSTURE SETTING TABLE TB

| | POSITIONS OF RETRACT ROLLS | | | | |
|---|---|---|---|---|---|
| NO. | R5 | R4 | R3 | R2 | R1 |
| 1 | UP | UP | UP | UP | UP |
| 2 | UP | UP | UP | DOWN | UP |
| 3 | UP | UP | UP | UP | DOWN |
| 4 | UP | UP | UP | DOWN | DOWN |
| 5 | DOWN | UP | UP | DOWN | UP |
| 6 | DOWN | UP | UP | UP | DOWN |
| 7 | DOWN | UP | UP | DOWN | DOWN |
| 8 | DOWN | DOWN | DOWN | UP | UP |
| 9 | UP | UP | DOWN | DOWN | UP |
| 10 | UP | UP | DOWN | UP | DOWN |
| 11 | DOWN | DOWN | DOWN | DOWN | UP |
| 12 | DOWN | DOWN | DOWN | UP | DOWN |
| 13 | UP | UP | DOWN | DOWN | DOWN |
| 14 | DOWN | DOWN | DOWN | DOWN | DOWN |

FIG. 13

101'

| | | IMAGE FORMATION COLORS | | |
|---|---|---|---|---|
| NO. | NUMBER OF COLORS | K (BLACK) | CMY (CYAN, MAGENTA, AND YELLOW) | G (GREEN) |
| ☑ 1 | FIVE COLORS | ○ | ○ | ○ |
| ☐ 2 | FOUR COLORS | ○ | ○ | |
| ☐ 3 | FOUR COLORS | | ○ | ○ |
| ☐ 4 | THREE COLORS | | ○ | |
| ☐ 5 | TWO COLORS | ○ | | ○ |
| ☐ 6 | ONE COLOR | ○ | | |
| ☐ 7 | ONE COLOR | | | ○ |
| ☐ 8 | ZERO COLOR | | | |

101a' 101a' 101a'

FIG. 14

POSTURE SETTING TABLE T9'

| POSITIONS OF RETRACT ROLLS | | | |
|---|---|---|---|
| R5 | R4 | R3 | R1 |
| UP | UP | UP | UP |
| UP | UP | UP | DOWN |
| DOWN | UP | UP | UP |
| DOWN | UP | UP | DOWN |
| UP | UP | DOWN | UP |
| UP | UP | DOWN | DOWN |
| DOWN | DOWN | DOWN | UP |
| DOWN | DOWN | DOWN | DOWN |

INTERMEDIATE TRANSFER UNIT, TRANSFER DEVICE AND IMAGE FORMING APPARATUS

CROSS-REFERENCE TO RELATED APPLICATIONS

This application is based on and claims priority under 35 USC 119 from Japanese Patent Application No. 2009-98010 filed Apr. 14, 2009.

BACKGROUND

1. Technical Field

The invention relates to an intermediate transfer unit, a transfer device and an image forming apparatus.

2. Related Art

There has been an image forming apparatus, such as a copier or a printer, of the electrophotographic system that forms a color image using five or more colors including not only four colors of yellow, magenta, cyan and black, but also one or more of red, blue, green, gold, silver, a fluorescent color, pale cyan and plane magenta (so called light cyan and light magenta).

SUMMARY

According to an aspect of the invention, an intermediate transfer unit includes an endless belt-type intermediate transfer body, a first moving member, a second moving member, a third moving member, a first movement controller, a second movement controller and a third movement controller. An outside surface of the endless belt-type intermediate transfer body whose outside surface passes, along a rotation direction thereof, through an opposing area where the intermediate transfer body is opposed to a first image carrier and a plurality of second image carriers which are arranged on a downstream side of the first image carrier in the rotation direction and which are arranged in a line substantially linearly. The first moving member is disposed on a rear side of the intermediate transfer body and on an upstream side of the first image carrier in the rotation direction. The first moving member is configured to be movable between a first position and a second position which is further away from the first carrier than the first position. The second moving member is disposed on the rear side of the intermediate transfer body and between the first image carrier and one of the second image carriers which is disposed most-upstream in the rotation direction among the second image carriers. The second moving member is configured to be movable between a third position and a fourth position which is further away from the one of the second image carriers than the third position. The third moving member is disposed on the rear side of the intermediate transfer body and between the first image carrier and another one of the second image carriers which is disposed most-downstream in the rotation direction among the second image carriers. The third moving member is configured to be movable between a fifth position and a sixth position which is further away from said another one of the second image carriers than the fifth position. A first line connecting the second moving member located in the third position and the third moving member located in the fifth moving position is inclined with respect to a line connecting the first moving member located in the first position and the second moving member located in the third position. When the first image carrier is used, the first movement controller moves the first moving member to the first position. When the first image carrier is not used, the first movement controller moves the first moving member to the second position. When the second image carriers are used, the third movement controller moves the third moving member to the fifth position. When the second image carriers are not used, the third movement controller moves the third moving member to the sixth position. When any of the first and second image carriers is used, the second movement controller moves the second moving member to the third position. When the first and second image carriers are not used, the second movement controller moves the second moving member to the fourth position.

BRIEF DESCRIPTION OF THE DRAWINGS

Exemplary embodiments of the invention will be described in detail below based on the accompanying drawings, wherein:

FIG. 3A is a status explanatory diagram of the first link in the case where a first retracting roll is moved to a contact position, and FIG. 3B is a status explanatory diagram of the first link in the case where the first retracting roll is moved to a separation position;

FIG. 5 is an explanatory diagram of an image formation color setting screen according to Embodiment 1 of the present invention;

FIG. 6 is an explanatory diagram of a posture setting table according to Embodiment 1 of the present invention;

FIG. 13, which corresponds to FIG. 5 of Embodiment 1, is an explanatory diagram of an image formation color setting screen according to Embodiment 2 of the present invention; and FIG. 14, which corresponds to FIG. 6 of Embodiment 1, is an explanatory diagram of a posture setting table according to Embodiment 2 of the present invention.

DETAILED DESCRIPTION

With reference to the accompanying drawings, specific examples (hereinafter referred to as "examples") of exemplary embodiments of the invention will be described. It should be noted that the invention is not limited to the following examples.

For easy understanding of the following description, in figures, the forward or backward direction is denoted by the X-axis direction, the leftward or rightward direction is denoted by the Y-axis direction, and the upward or downward direction is denoted by the Z-axis direction. In addition, the directions or sides represented by arrows X, -X, Y, -Y, Z, and -Z are assumed to be the forward direction, the backward direction, the rightward direction, the leftward direction, the upward direction, and the downward direction or the front side, the rear side, the right side, the left side, the upper side, and the lower side.

In addition, in the figures, "o" with "●" being drawn therein represents an arrow toward the front side from the rear of the sheet, and "o" with "x" being drawn therein represents an arrow toward the rear side from the front side of the sheet.

In addition, in description with reference to the accompanying drawings, for easy understanding thereof, members other than necessary members for the description will be omitted appropriately.

Embodiment 1

Figure 1:
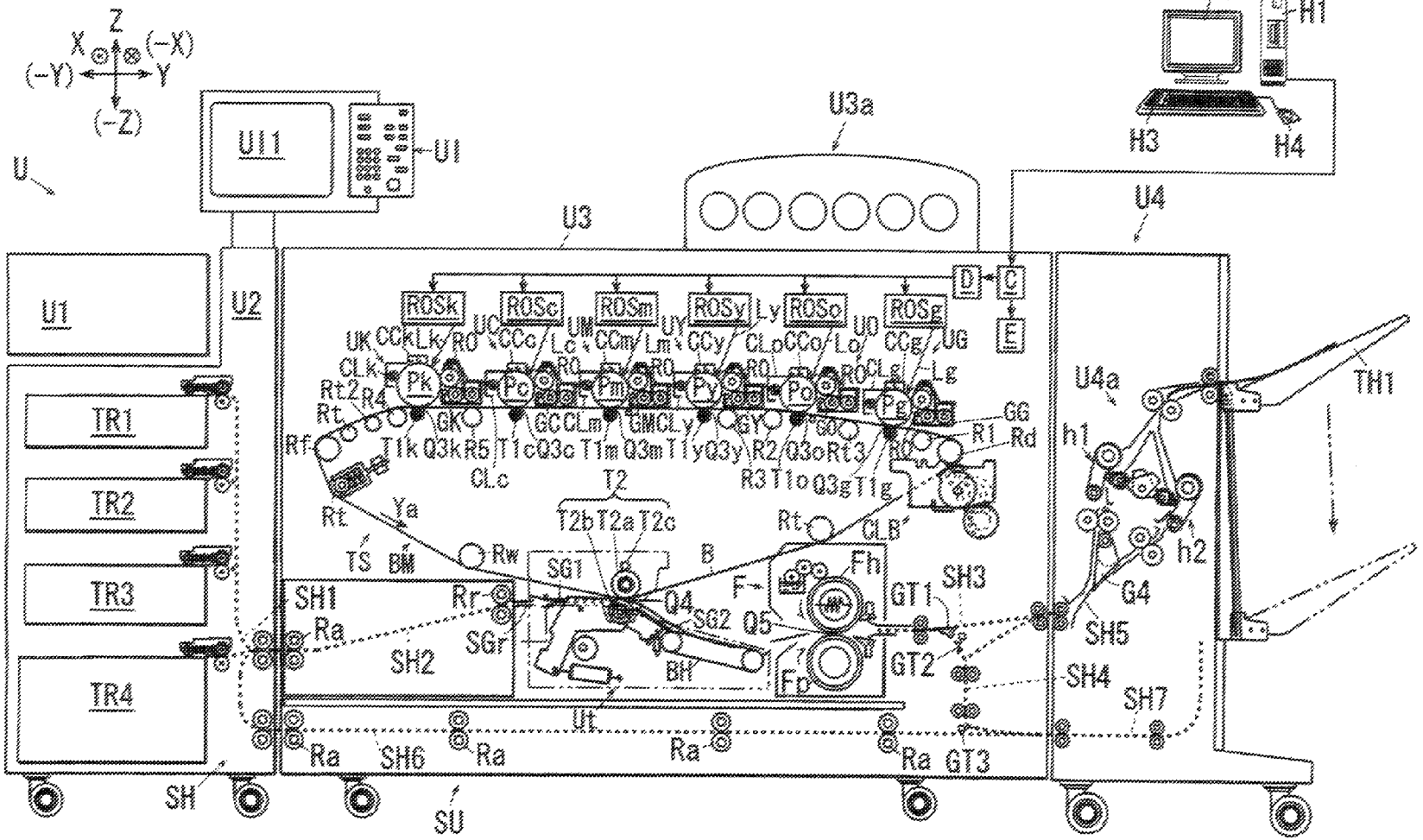
FIG. 1 is an explanatory diagram of the whole image forming apparatus according to Embodiment 1 of the present invention.

FIG. 1 is an explanatory diagram of the whole image forming apparatus according to Embodiment 1 of the present invention.

As shown in FIG. 1, the image forming apparatus U according to Embodiment 1 includes a user interface UI as an example of an operation section, an image input device U1 as an example of an image information input device, a paper feed device U2, an image forming apparatus main body U3, and a sheet processing device U4.

The above-described user interface UI has input buttons such as a copy start key as an example of an image formation starting button, a copy number setting key as an example of an image forming number setting button, and numeric keys as an example of number input buttons and a display device UI1.

The above-described image input device U1 is an example of an automatic document feeder and is configured of an image scanner or the like as an example of an image reading device. In FIG. 1, the image input device U1 reads out a document, not shown in the figure, converts the read-out information into image information, and inputs the image information to the image forming apparatus main body U3. Also, a client personal computer PC as an example of an image information transmitting device is connected to the image forming apparatus main body U3 according to Embodiment 1. Thus, image formation color setting information, in which image formation colors used when an image forming operation is performed are set, and the above-described image information that is divided into colors in accordance with the set image formation colors are input from the above-described client personal computer PC.

The above-described client personal computer PC according to Embodiment 1 is configured by a so-called computing machine, that is, a so-called computer device. The above-described client personal computer CP is configured by a computer main body H1 as an example of a main body of the image information transmitting device, a display H2 as an example of a display member, a keyboard H3, a mouse H4 and the like as examples of an input member, an HD drive, that is, a so-called hard disk drive as an example of an information storing member not shown in the figure, and the like.

The paper feed device U2 has paper feed trays TR1 to TR4 as an example of plural paper feed sections, final transfer bodies housed in the paper feed trays TR1 to TR4, and a paper feed path SH1 that takes out and feeds a recording sheet S as an example of a medium to the image forming apparatus main body U3, and the like.

As shown in FIG. 1, the image forming apparatus main body U3 has an image recording section that performs image recording for the recording sheet S fed from the paper feed device U2, a toner dispenser device U3*a* as an example of a developer supplying device, a sheet transport path SH2, a sheet discharge path SH3, a sheet inverting path SH4, a sheet circulation path SH6, and the like. Also, the image recording section will be described later.

Also, the image forming apparatus main body U3 has a control section C, a laser driving circuit D, which is controlled by the control section C, as an example of a driving circuit for a latent image writing device, a power supply circuit E that is controlled by the control section C, and the like. The above-described laser driving circuit D outputs laser driving signals according to image information of G: Green, that is, a green color, O: Orange, that is, an a lamp light color, Y: Yellow, that is, a yellow color, M: Magenta, that is, a magenta color, C: Cyan, that is, a cyan color, and K: Black, that is, a black color, which are input from the above-described image input device U1, to latent image forming devices ROSg, ROSo, ROSy, ROSm, ROSc, and ROSk of colors of G to K at a preset time, that is, a so-called preset timing.

Also, on the lower side of the latent image forming devices ROSg to ROSk of the respective colors, image carrier units UG, UO, UY, UM, UC, and UK of the respective colors of G to K and developing units GG, GO, GY, GM, GC, and GK of the respective colors of G to K as examples of developing units are detachably attached.

The black image carrier unit UK is an example of a sixth image carrier and has a black photosensitive drum Pk as an example of a black image carrier, a charging unit CCk, and a cleaner CLk as an example of an image carrier cleaner. Also, on the right side of the above-described photosensitive drum Pk, a developing roll RO as an example of the developing member of the black developing unit GK is adjacently disposed.

The image carrier units UG to UC of the other colors of G to C also have a green photosensitive drum Pg as an example of a first image carrier and an example of the image carrier of a first extra color, an orange photosensitive drum Po as an example of a second image carrier and as an example of the image carrier of a second extra color, a yellow photosensitive drum Py as an example of a third image carrier, a magenta photosensitive drum Pm as an example of a fourth image carrier, and a cyan photosensitive drum Pc as an example of a fifth image carrier. Also, with respect to the above-described photosensitive drums Pg to Pc, charging units CCg, CCo, CCy, CCm, and CCc and cleaners CLg, CLo, CLy, CLm, and CLc of the corresponding colors are adjacently disposed.

Also, on the right side of the above-described photosensitive drums Pg to Pc, developing rolls R0 as examples of developing members of the developing units GG to GC of the respective colors are adjacently disposed.

Also, in Embodiment 1, the photosensitive drum Pk of the K color which is used frequently and whose surface is worn more is configured to have a diameter larger than those of the photosensitive drums Pg to Pc of the other colors so as to respond to high-speed rotation and lengthen its lifetime.

Two extra-color photosensitive drums Pg and Po as examples of the first image carrier and as the image carrier of extra colors are configured by the above-described green photosensitive drum Pg and the above-described orange photosensitive Drum Po. Also, three three-color photosensitive drums Py, Pm, and Pc as examples of primary color-image carrier are configured by the above-described yellow photosensitive drum Py, the above-described magenta photosensitive drum Pm, and the above-described cyan photosensitive drum Pc. Also, second image carrier Py, Pm, Pc, and Pk are configured by the above-described three-color photosensitive drums Py, Pm, and Pc and the above-described black photosensitive drum Pk.

Also, visible-image forming members (UG+GG), (UO+GO), (UY+GY), (UM+GM), (UC+GC), and (UK+GK) are configured by the above-described image carrier units UG to UK and the above-described developing units GG to GK.

In FIG. 1, after the photosensitive drums Pg to Pk are uniformly charged by the charging units CCg to CCk, electrostatic latent images are formed on the surfaces thereof by laser beams Lg, Lo, Ly, Lm, Lc, and Lk as examples of latent image writing beams output by the above-described latent-image forming devices ROSg to ROSk. The electrostatic latent images formed on the surfaces of the above-described photosensitive drums Pg to Pk are developed into images of colors of G: Green, O: Orange, Y: Yellow, M: Magenta, C: Cyan, and K: Black, that is, toner images as examples of visible images by the developing units GG to GK.

The toner images formed on the surfaces of the photosensitive drums Pg to Pk are sequentially transferred onto an intermediate transfer belt B as an example of an intermediate transfer body in an overlapping manner in primary transfer areas Q3*g*, Q3*o*, Q3*y*, Q3*m*, Q3*c*, and Q3*k* as examples of intermediate transfer areas set on the lower side of the photosensitive drums Pg to Pk by primary transfer rolls T1*g*, T1*o*, T1*y*, T1*m*, T1*c*, and T1*k* as examples of intermediate transfer members, whereby a multiple-color image, that is, a so-called color image is formed on the intermediate transfer belt B. The color image formed on the intermediate transfer belt B is transported to a secondary transfer area Q4.

Also, in the case where there is only black image data, only the black photosensitive drum Pk and the developing unit GK are used. Accordingly, only a black toner image is formed.

Also, in Embodiment 1, a segment connecting the primary transfer areas Q3*y*, Q3*m*, and Q3*c* of the three-color photosensitive drums Py to Pc and the primary transfer area Q3*k* of the above-described black photosensitive drum Pk is set in advance so as to extend in a straight line.

After the primary transfer, the remaining toner disposed on the surfaces of the photosensitive drums Pg to Pk is cleaned by the cleaners CLg to CLk for photosensitive drums.

Figure 2:
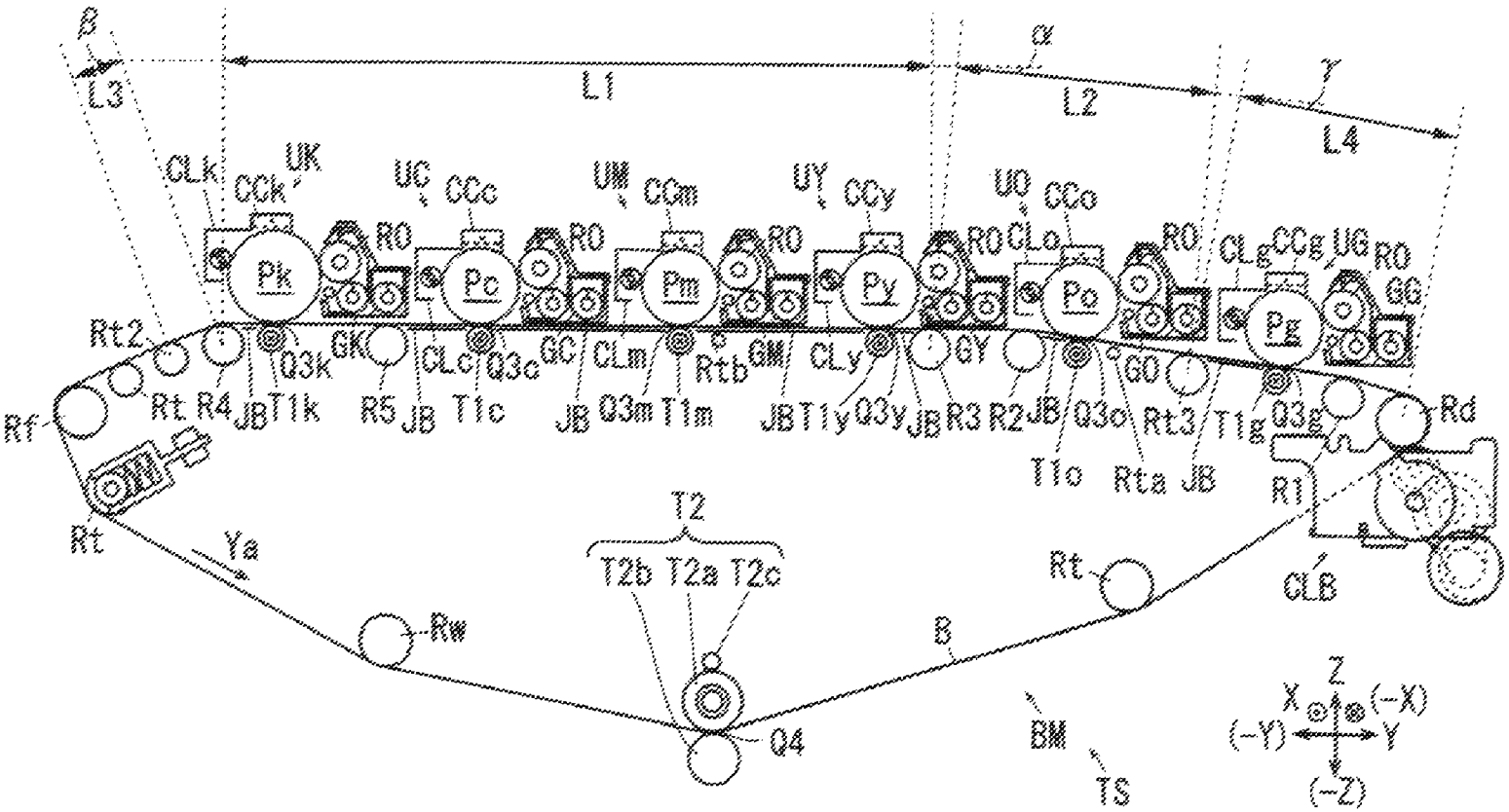
FIG. 2 is an explanatory diagram of the whole belt module according to Embodiment 1 of the present invention.

FIG. 2 is an explanatory diagram of the whole belt module according to Embodiment 1 of the present invention.

On the lower side of the above-described photosensitive drums Pg to Pk, a belt module BM as an example of an intermediate transfer device is supported. The above-described belt module BM has the above-described intermediate transfer belt B. In the rear-side right end portion of the above-described intermediate transfer belt B, a belt driving roll Rd is disposed as an example of a first tension applying member, an example of a first tension applying member, and an example of an intermediate transfer body driving member. The above-described belt driving roll Rd rotates the above-described intermediate transfer belt B in the direction of arrow Ya as a rotation direction. Also, on the rear side of the above-described intermediate transfer belt B, a second tension applying member Rt2 is disposed on the left side of the above-described black photosensitive drum Pk as an example of a second tension applying member. Between the above-described photosensitive drums Pg and Po, a fourth tension applying member Rt3 is disposed as an example of a third tension applying member. Also, on the rear side of the above-described intermediate transfer belt B, plural tension rolls Rt as examples of tension applying members that apply tension to the above-described intermediate transfer belt B are disposed. Also, on the rear side of the above-described intermediate transfer belt B, a working roll Rw as an example of a meandering prevention member that prevents meandering of the above-described intermediate transfer belt B, plural idle rollers Rf as examples of driven members, and a backup roll T2*a* as an example of a secondary transfer opposing member are disposed.

Accordingly, in the above-described belt module BM according to Embodiment 1, the above-described intermediate transfer belt B is wound on the rolls Rd, Rt2, Rt3, Rt, Rw, Rf, T2*a*, and the like.

Also, in Embodiment 1, on the upstream side of the primary transfer roll T1*g* of the G color in the direction of arrow Ya, a first retracting roll R1 that is supported so as to be movable in a contact/separation direction that is a direction perpendicular to the direction of arrow Ya is disposed as an example of a first moving member. The above-described first retracting roll R1 of Embodiment 1 is supported so as to be movable between a first contact position in which the above-described intermediate transfer belt B is brought into contact with the green photosensitive drum Pg and a first separation position in which the intermediate transfer belt B is separated from the green photosensitive drum Pg. In other words, the above-described first retracting roller R1 is supported to be movable between the above-described first contact position as an example of a first position in which tension is applied to the above-described intermediate transfer belt B and the above-described first separation position as an example of a second position that is further away from the above-described intermediate transfer belt B than the first contact position.

Also, between the above-described primary transfer rolls T1*o* and T1*y* of OY, a second retracting roll R2 as an example of a fifth moving member and a third retracting roll R3 as an example of a second moving member, which are configured in the same manner as the above-described first retracting roll R1, are arranged side by side. The above-described second retracting roll R2 of Embodiment 1 is supported so as to be movable between a second contact position in which the above-described intermediate transfer belt B is brought into contact with the above-described orange photosensitive drum Po and a second separation position in which the above-described intermediate transfer belt B is separated from the above-described orange photosensitive drum Po. In other words, the above-described second retracting roll R2 is supported to be movable between the above-described second contact position as an example of a ninth position in which tension is applied to the above-described intermediate transfer belt B and the above-described second separation position as an example of a tenth position that is further away from the above-described intermediate transfer belt B than the above-described second contact position. Also, the third retracting roll R3 of Embodiment 1 is supported to be movable between a third contact position in which the above-described intermediate transfer belt B is brought into contact with all the above-described three-color photosensitive drums Py to Pc and a third separation position in which the above-described intermediate transfer belt B is separated from all the above-described three-color photosensitive drums Py to Pc. In other words, the above-described third retracting roll R3 is supported to be movable between the above-described third contact position as an example of a third position in which tension is applied to the above-described intermediate transfer belt B and the above-described third separation position as an example of a fourth position that is further away from the above-described intermediate transfer belt B than the above-described third contact position.

Also, on the downstream side of the primary transfer roll T1*k* of the K color in the direction of arrow Ya, a fourth retracting roll R4 that is configured in the same manner as the above-described retracting rolls R1 to R3 is disposed as an example of a third moving member. The above-described fourth retracting roll R4 of Embodiment 1 is supported so as to be movable between a fourth contact position in which the above-described intermediate transfer belt B is brought into contact with the black photosensitive drum Pk and a fourth separation position in which the intermediate transfer belt B is separated from the black photosensitive drum Pk. In other words, the above-described fourth retracting roll R4 is supported to be movable between the above-described fourth contact position as an example of a fifth position in which tension is applied to the above-described intermediate transfer belt B and the above-described fourth separation position as an example of a sixth position that is further away from the above-described intermediate transfer belt B than the fourth contact position.

Also, between the above-described primary transfer rolls T1*c* and T1*k* of CK, a fifth retracting roll R5 that is configured in the same manner as the above-described retracting rolls R1 to R4 is disposed as an example of a fourth moving member. The above-described fifth retracting roll R5 of Embodiment 1 is supported so as to be movable between a fifth contact position in which the above-described intermediate transfer belt B is brought into contact with any one or both of the above-described three-color photosensitive drums Py to Pc and the black photosensitive drum Pk and a fifth separation position in which the above-described photosensitive drums Py to Pk of YMCK are separated from the above-described intermediate transfer belt B. In other words, the above-described fifth retracting roll R5 is supported to be movable between the above-described fifth contact position as an example of a seventh position in which tension is applied to the above-described intermediate transfer belt B and the above-described fifth separation position as an example of an eighth position that is further away from the above-described intermediate transfer belt B than the above-described fifth contact position.

Also, in Embodiment 1, as shown in FIG. 2, it is set in advance such that a first segment L1 extending along the outer surface of the above-described intermediate transfer belt B from the third retracting roll R3 located at the above-described third contact position to the fourth retracting roll R4 located at the above-described fourth contact position is in the shape of a straight line. Also, it is set in advance such that a second segment L2 extending along the outer surface of the above-described intermediate transfer belt B from the above-described third intermediate transfer body supporting member Rt3, which is fixedly supported, to the third retracting roll R3 located at the above-described third contact position is in the shape of a straight line. Also, it is set in advance such that a third segment L3 extending along the outer surface of the above-described intermediate transfer belt B from the fourth retracting roll R4 located at the fourth contact position to the above-described second intermediate transfer body supporting member Rt2, which is fixedly supported, is in the shape of a straight line. Also, it is set in advance such that a fourth segment L4 extending along the outer surface of the above-described intermediate transfer belt B from the above-described belt driving roll Rd, which fixedly supported, to the above-described third intermediate transfer body supporting member Rt3 is in the shape of a straight line.

In Embodiment 1, the second segment L2 is tilted to the lower side with respect to the above-described first segment L1 by a first angle $\alpha$. Also, the third segment L3 is tilted to the lower side with respect to the above-described first segment L1 by a second angle $\beta$. Also, the fourth segment L4 is tilted to the lower side with respect to the above-described second segment L2 by a third angle $\gamma$.

Accordingly, in Embodiment 1, the posture of the above-described intermediate transfer belt B is set in advance so that the segments L2, L3, and L4 extend to be tilted to the lower side, which is the rear side of the above-described intermediate transfer belt B, by the above-described angles $\alpha$, $\beta$, and $(\alpha+\gamma)$ with respect to the first segment L1. Accordingly, in Embodiment 1, it is set in advance such that a segment, not shown in the figure, connecting the above-described first retracting roll R1 and the above-described third retracting roll R3 is tilted to the lower side with respect to the first segment L1.

Also, between the above-described third intermediate transfer body supporting member Rt3 and the above-described second retracting roll R2, a first separation-time winding roll Rta is disposed as an example of a third tension applying member. The above-described first separation-time winding roll Rta of Embodiment 1 is disposed in advance so that the first separation-time winding roll Rta is separated from the above-described intermediate transfer belt B when the above-described second retracting roll R2 is moved to the above-described second contact position, while the above-described first separation-time winding roll Rta is disposed in a first separation-time contact position where it supports the above-described intermediate transfer belt B from the rear side when the above-described second retracting roll R2 is moved to the above-described second separation position.

Also, between the third retracting roll R3 and the fifth retracting roll R5, a second separation-time winding roll Rtb is disposed as an example of the second third tension applying member. The above-described second separation-time winding roll Rtb of Embodiment 1 is disposed in advance such that the second separation-time winding roll Rtb is separated from the above-described intermediate transfer belt B when the above-described retracting rolls R3 and R5 are moved to the above-described contact positions, while the above-described second separation-time winding roll Rtb is in a second separation-time contact position where it supports the above-described intermediate transfer belt B from the rear side when the above-described third retracting roll R3 is moved to the above-described third separation position or when the above-described fifth retracting roll R5 is moved to the above-described fifth separation position.

Also, on the downstream side of the above-described primary transfer rolls T1*g* to T1*k* of G to K in the direction of arrow Ya, neutralization plates JB having a flat plate shape as an example of a neutralization member that neutralizes electric charges disposed on the rear face of the above-described intermediate transfer belt B are disposed. Also, the above-described neutralization plates JB of Embodiment 1 are disposed so as not to be brought into contact with the above-described intermediate transfer roll B. For example, the above-described neutralization plates JB can be disposed in positions separated from the rear face of the above-described intermediate transfer roll B by 2 mm.

Belt supporting rolls Rd, Rt, Rw, Rf, T2*a*, and R1 to R5 as examples of intermediate transfer body supporting members that support the above-described intermediate transfer belt B so as to be rotatable from the rear face thereof are configured by the above-described rolls Rd, Rt, Rw, Rf, T2*a*, and R1 to R5.

Also, the belt module BM of Embodiment 1 is configured by the above-described intermediate transfer belt B, the above-described belt supporting rolls Rd, Rt, Rt2, Rt3, Rta, Rtb, Rw, Rf, T2*a*, and R1 to R5, the above-described primary transfer rolls T1*g* to T1*k*, the above-described neutralization plates JB, and the like.

Also, as shown in FIG. 1, on the lower side of the above-described backup roll T2*a*, a secondary transfer unit Ut is disposed. A secondary transfer roll T2*b* as an example of a secondary transfer member of the secondary transfer unit Ut is disposed so as to be able to be separated from or brought into contact with the backup roll T2*a* with the above-described intermediate transfer belt B interposed therebetween, and a secondary transfer area Q4 is formed by an area in which the above-described secondary transfer roll T2*b* is in pressure-contact with the above-described intermediate transfer belt B. Also, a contact roll T2*c* as an example of a contact member for voltage application abuts against the above-described backup roll T2*a*, and a secondary transfer unit T2 as an example of a final transfer member is configured by the above-described rolls T2*a* to T2*c*.

To the above-described contact roll T2*c*, a secondary transfer voltage that has the same polarity as the charged polarity of toner is applied from the power supply circuit, which is controlled by the control section C, at a timing set in advance.

On the lower side of the above-described belt module BM, the sheet transport path SH2 is disposed. The recording sheet S that is fed from the paper feed path SH1 of the above-described paper feed device U2 is transported to the above-described sheet transport path SH2 by the transport roll Ra as an example of a medium transport member and is transported to the secondary transfer area Q4 through a medium guiding member SGr and a pre-transfer medium guiding member SG1 at a timing matching the transport of a toner image to the secondary transfer area Q4 by a register roll Rr as an example of a feed timing adjusting member.

Also, the above-described medium guiding member SGr and the register roll Rr are fixed to and supported by the above-described image forming apparatus main body U3.

The toner image formed on the above-described intermediate transfer belt B is transferred to the above-described recording sheet S by the secondary transfer unit T2 when passing through the above-described secondary transfer area Q4. Also, in the case of a full-color image, toner images that are primarily transferred onto the surface of the intermediate transfer belt B in an overlapping manner are secondarily transferred altogether to the recording sheet S.

The above-described intermediate transfer belt B after the secondary transfer is cleaned by a belt cleaner CLB as an example of an intermediate transfer body cleaner. In addition, the secondary transfer roll T2*b* and the belt cleaner CLB described above are supported so as to be able to be separated from and brought into contact with the intermediate transfer belt B.

A transfer device TS that transfers images formed on the surfaces of the photosensitive drums Py to Po to a recording sheet S is configured by the above-described belt module BM, the above-described secondary transfer unit T2, the above-described belt cleaner CLB, and the like.

The recording sheet S on which the toner image is secondarily transferred is transported to a fixing device F through a post-transfer medium guiding member SG2 and a sheet transport belt BH as an example of a prior-fixing medium transport member. The above-described fixing device F has a heating roll Fh as an example of a heating fixing member and a pressing roll Fp as an example of a pressing fixing member, and a fixing area Q5 is formed by an area in which the heating roll Fh and the pressing roll Fp are tightly brought into contact with each other.

The toner image formed on the above-described recording sheet S is heated so as to be fixed by the fixing device F when passing through the fixing area Q5. On the downstream side of the fixing device F, a transport path switching member GT1 is disposed. The above-described transport path switching member GT1 selectively switches the recording sheet S that is transported by the sheet transport path SH2 and is heated so as to be fixed in the fixing area Q5 to either the sheet discharge path SH3 or the sheet inverting path SH4 of the sheet processing device U4. The recording sheet S transported to the sheet discharge path SH3 is transported to the sheet transport path SH5 of the sheet processing device U4.

In the middle of the sheet transport path SH5, a curl correcting device U4*a* is disposed, and a switching gate G4 is disposed in the above-described sheet transport path SH5 as an example of the transport path switching member. The above-described switching gate G4 transports the recording sheet S that is transported from the sheet transport path SH3 of the above-described image forming apparatus main body U3 to any of a first curl correcting member h1 and a second curl correcting member h2 in accordance with the direction of a curve, that is, a so-called curl. The recording sheet S transported to the first curl correcting member h1 or the second curl correcting member h2 described above has the curl being corrected while passing through it. The recording sheet S of which the curl is corrected is discharged from a discharge roll Rh as an example of a discharge member in the state in which the image fixing surface of the sheet faces the upper side, that is, a so-called a face-up state in a discharge tray TH1 as an example of a discharge unit of the sheet processing device U4.

The recording sheet S that is transported to the sheet inverting path SH4 side of the image forming apparatus main body U3 by the above-described transport path switching member GT1 passes a transport-direction regulating member, that is, a so-called Mylar gate GT2 that is configured by an elastic thin film member in a pushing state and is transported to the sheet inverting path SH4 of the image forming apparatus main body U3.

On the downstream end of the sheet inverting path SH4 of the above-described image forming apparatus main body U3, a sheet circulating path SH6 and a sheet inverting path SH7 are connected to each other, and also in the connection portion thereof, a Mylar gate GT3 is disposed. The recording sheet S transported to the sheet transporting path SH4 through the above-described switching gate GT1 passes through the Mylar gate GT3 and is transported to the sheet inverting path SH7 of the sheet processing device U4. In the case where double-sided printing is performed, the recording sheet S transported by the sheet transport path SH4 directly passes through the above-described Mylar gate GT3 once and is transported to the sheet inverting path SH7. Thereafter, when the recording sheet S is transported in the reverse direction, that is, so-called switched back, the direction of the transport is regulated by the above-described Mylar gate GT3, and the switched back recording sheet S is transported to the sheet circulating path SH6 side. The recording sheet S transported to the sheet circulating path SH6 is re-sent to the above-described transfer area Q4 through the above-described paper feed path SH1.

On the other hand, when the recording sheet S transported by the sheet inverting path SH4 is switched back after the rear end of the recording sheet S passes though the Mylar gate GT2 and before passing though the Mylar gate GT3, the transport direction of the recording sheet S is regulated by the Mylar gate GT2, and the recording sheet S is transported to the sheet transport path SH5 in the state in which the front and rear sides thereof are reversed.

The recording sheet S of which the front and rear sides are reversed has the curl being corrected by the curl correcting member U4*a* and then can be discharged in the state in which the image fixing surface of the recording sheet S faces the lower side, that is, a so-called face-down state in the sheet discharge tray TH1 of the above-described sheet processing device U4.

The sheet transport path SH is configured by the elements denoted by the above-described reference signs SH1 to SH7. In addition, the medium transporting device SU is configured by the elements denoted by the above-described reference signs SH, Ra, Rr, Rh, SGr, SG1, SG2, BH, and GT1 to GT3.

(Description of Links LN1 to LN4)

Figure 3A:
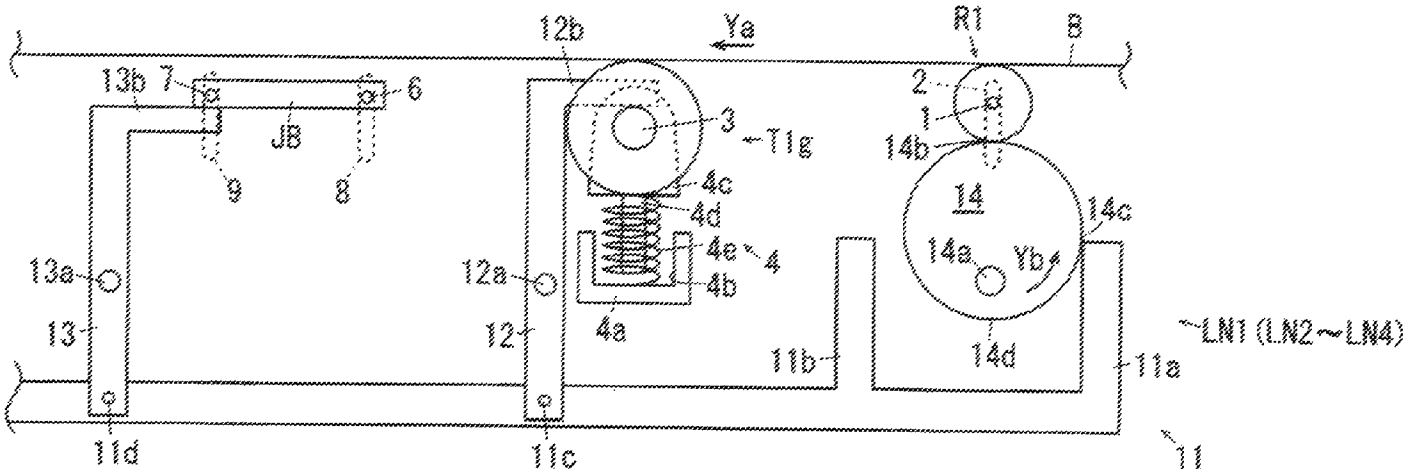
FIGS. 3A and 3B are enlarged explanatory diagrams of a major part of a first link according to Embodiment 1 of the present invention.
Figure 3B:
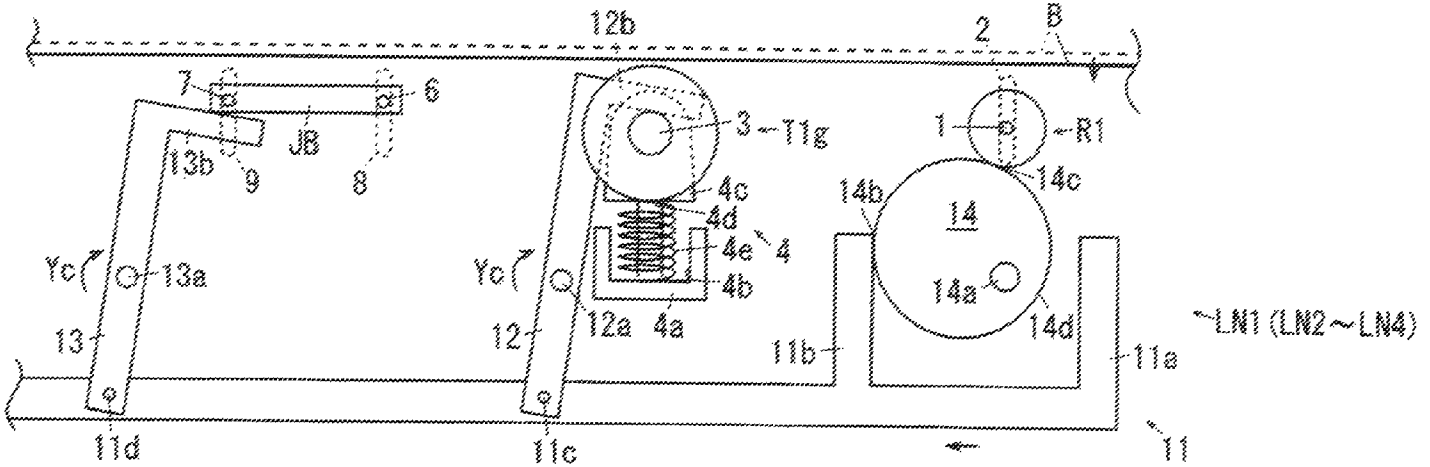

FIG. 3 is an enlarged explanatory diagram of a major part of a first link according to Embodiment 1 of the present invention. FIG. 3A is a status explanatory diagram of a first link in the case where the first retracting roll is moved to the first contact position. FIG. 3B is a status explanatory diagram of the first link in the case where the first retracting roll is moved to a separation position.

In FIG. 3, a rotation shaft 1 of the first retracting roll R1 of Embodiment 1 is supported to be rotatable in the state where it penetrates a first guide groove 2 that is formed in a casing body, not shown in the figure, disposed on the front and rear ends of the above-described belt module BM and that extends in the contact/separation direction. In other words, the above-described first retracting roll R1 of Embodiment 1 is supported so as to be movable in the contact/separation direction by having the above-described rotation shaft 1 guided by the above-described first guide groove 2.

Also, a rotation shaft 3 of the above-described primary transfer roll T1*g* of the G color is supported by a suppression member 4 that is supported by the casing body of the above-described belt module BM and that extends in the contact/separation direction. The above-described suppression member 4 of Embodiment 1 has a seat portion 4*a* that is supported by the above-described frame body. Inside the seat portion 4*a*, an elastic body housing space 4*b* extending in the contact/separation direction is formed. Also, on the intermediate transfer belt B side of the seat potion 4*a*, a bearing portion 4*c* that supports the above-described rotation shaft 3 to be rotatable is disposed. On the lower face of the above-described bearing portion 4*c*, an elastic body penetrating/supporting portion 4*d* that extends inside the above-described elastic body housing space 4*b* is formed. Also, between the above-described seat portion 4*a* and the above-described bearing portion 4*c*, a suppression spring 4*e* as an example of an elastic body is housed in the elastic body housing space 4*b* of the above-described seat portion 4*a* and is installed in the state where it penetrates the elastic body penetrating/supporting portion 4*d* of the above-described bearing portion 4*c*. In other words, the above-described transfer roll T1*g* of the G color of Embodiment 1 is supported to be movable in the contact/separation direction in the state being biased to the above-described intermediate transfer belt B side by the above-described suppression spring 4*e* that can be expanded and contracted along the above-described elastic body housing space 4*b* and the above-described elastic body penetrating/supporting portion 4*d*.

Also, in both end portions of the above-described neutralization plate JB in the direction of arrow Ya, protrusion portions 6 and 7 protruding from the front and rear end portions of the neutralization plate JB to the outer side thereof are formed. The above-described protrusion portions 6 and 7 are supported in the state where they penetrate a second guide groove 8 and a third guide groove 9, which are formed in the frame body of the above-described belt module BM and which extend in the contact/separation direction. In other words, the above-described neutralization plate JB of Embodiment 1 is supported to be movable in the contact/separation direction by having the above-described protrusion portions 6 and 7 guided by the guide grooves 8 and 9.

Also, on the lower side of the above-described first retracting roll R1, the above-described primary transfer roll T1*g* of the G color, and the above-described neutralization plate JB, a link main body 11, which extend from the upstream side of the above-described first retracting roll R1 in the direction of arrow Ya to the downstream side of the neutralization plate JB in the direction of arrow Ya and which is movable in the direction of arrow Ya, is disposed as an example of a link member main body. In the upstream end of the above-described link main body 11 of Embodiment 1 in the direction of arrow Ya, a first engaged portion 11*a* extending toward the above-described intermediate transfer belt B side is formed. Also, in the above-described link main body 11, a second engaged portion 11*b* extending toward the above-described intermediate transfer belt B side is formed so as to be parallel to the above-described first engaged portion 11*a* in a position corresponding to the downstream side of the first retracting roll R1 in the direction of arrow Ya and the upstream side of the primary transfer roll T1*g* of the G color in the direction of arrow Ya. Also, in the above-described link main body 11, a first connection shaft 11*c* and a second connection shaft 11*d* are formed in positions corresponding to the downstream side of the primary transfer roll T1*g* of the G color in the direction of arrow Ya and the downstream side of the above-described neutralization plate JB in the direction of arrow Ya. Accordingly, by the connection shafts 11*c* and 11*d*, a first link arm 12 and a second link arm 13 are supported as examples of a first arm portion and a second arm portion extending toward the above-described intermediate transfer belt B side.

The center portions of the above-described link arms 12 and 13 of Embodiment 1 are supported so as to be rotatable by the first rotation shaft 12*a* and the second rotation shaft 13*a* that are supported by the casing frame of the above-described belt module BM. Also, in the upper end portion of the above-described first link arm 12, a first contact portion 12*b* that extends toward the upstream side in the direction of arrow Ya and is brought into contact with the rotation shaft 3 from the upper side thereof is formed. Also, in the upper end portion of the above-described second link arm 13, a second contact portion 13*b* that extends toward the upstream side in the direction of arrow Ya and is brought into contact with the neutralization plate JB from the lower side thereof is formed.

Also, between the engaged portions 11*a* and 11*b*, an eccentric cam 14 as an example of an eccentric rotation member is disposed. The above-described eccentric cam 14 of Embodiment 1 is formed to have a circular plate shape in section, and a rotation center 14*a* of the above-described eccentric cam 14 is supported by the casing body of the above-described belt module BM to be rotatable.

Also, on the outer circumferential face of the above-described eccentric cam 14, a first end point 14*b* that is an end point located farthest from the above-described rotation center 14*a*, a second end point 14*c* that is departed to the upstream side by 90 degrees from the above-described first end point 14*b* in the direction of arrow Yb as an example of the rotation direction of the eccentric rotation member, and a third end point 14*d* that is an end point departed from the first end point 14*b* to the upstream side by 180 degrees in the direction of arrow Yb and closest from the rotation center 14*a* are set in advance.

Here, in Embodiment 1, as shown in FIG. 3A, in the case where the lower end portion of the above-described first retracting roll R1 is supported in the state being brought into contact with the first end point 14*b* of the above-described eccentric cam 14, the above-described first retracting roll R1 is set to be moved to the above-described first contact position in which the above-described intermediate transfer belt B is brought into contact with the above-described photosensitive drum Pg, in advance.

In this case, the first engaged portion 11*a* of the above-described link main body 11 is supported in the state being engaged with the above-described eccentric cam 14 in the above-described second end point 14*c* disposed in the upstream end portion of the above-described eccentric cam 14 in the direction of arrow Ya.

Also, in the case where the eccentric cam 14 is rotated in the direction of arrow Yb in the state shown in FIG. 3A, the end point thereof supporting the lower end portion of the above-described first retracting roll R1 is moved, and as shown in FIG. 3B, the first retracting roll R1 is supported in the state where it is brought into contact with the vicinity of the second end point 14*c* of the above-described eccentric cam 14. In this case, the first retracting roll R1 is set in advance so as to be moved to a separation position in which the above-described intermediate transfer belt B is separated from the above-described photosensitive drum Pg by tension and/or the weight thereof. Also, at this time, the second engaged portion 11*b* of the above-described link main body 11 is suppressed by the outer circumferential face of the above-described eccentric cam 14 so as to be moved to the downstream side in the direction of arrow Ya.

In accordance with the movement of the connection shafts 11*c* and 11*d* to the downstream side in the direction of arrow Ya, the link arms 12 and 13 rotate around the rotation shafts 12*a* and 13*a* in the direction of arrow Yc that is opposite to the direction of arrow Yb. Accordingly, as shown in FIG. 3B, the above-described contact portions 12*b* and 13*b* are rotated to the above-described link main body 11 side. Accordingly, the above-described primary transfer roll T1*g* of the G color is suppressed by the above-described first contact portion 12*b* from above and is moved to the above-described link main body 11 side with resisting the suppressing force of the above-described suppression spring 4*e*. Also, the above-described neutralization plate JB is also moved from the state in which the lower face thereof is supported in the upper end portions of the guide grooves 8 and 9 by the above-described second contact potion 13*b* to the link main body 11 side due to the weight thereof.

Accordingly, the above-described first retracting roll R1, the above-described primary transfer roll T1*g* of the G color, and the above-described neutralization plate JB are linked to each other, are moved to the direction departing away from the above-described photosensitive drum Pg, and the above-described intermediate transfer belt B is separated from the above-described photosensitive drum Pg. Also, in Embodiment 1, the above-described first retracting roll R1, the above-described primary transfer roll T1*g* of the G color, and the above-described neutralization plate JB are also set in advance so as to be separated from the above-described intermediate transfer belt B.

Also, in the case where the above-described eccentric cam 14 is rotated in the direction of arrow Yc in the state shown in FIG. 3B, that is, in the case where the eccentric cam 14 is reversely rotated in the state shown in FIG. 3B, the end point supporting the lower end portion of the above-described first retracting roll R1 is moved. Thus, as shown in FIG. 3A, the first retracting roll R1 returns to the state in which the first retracting roll R1 is supported in the state where it is brought into contact with the vicinity of the first end point 14*b* of the above-described eccentric cam 14. In this case, the above-described first retracting roll R1 returns to the above-described first contact position and is brought into contact with the above-described intermediate transfer belt B to lift up the intermediate transfer belt B. Also, at this time, in accordance with the rotation of the above-described eccentric cam 14, the first engaged portion 11*a* of the above-described link main body 11 is suppressed by the outer circumferential face of the above-described eccentric cam 14 so as to be moved to the upstream side in the direction of arrow Ya.

In accordance with the movement of the above-described connection shafts 11*c* and 11*d* to the upstream side in the direction of arrow Ya, the above-described link arms 12 and 13 rotate around the above-described rotation shafts 12*a* and 13*a* in the direction of arrow Yb which is the opposite direction of the direction of arrow Yc. Accordingly, as shown in FIG. 3A, the above-described contact portions 12*b* and 13*b* are rotated to the above-described intermediate transfer belt B side. Therefore, the suppression by the above-described first contact portion 12*b* is released, and the above-described primary transfer roll T1*g* of the G color is moved to the above-described intermediate transfer belt B side by the suppressing force of the above-described suppression spring 4*e* so that the above-described intermediate transfer belt B abuts against the above-described photosensitive drum Pg. The lower face of the above-described neutralization plate JB is lifted to the upper side by the above-described second contact portion 13*b*.

By the above-described link main body 11, the above-described link aims 12 and 13, the above-described eccentric cam 14, and the like, a first link LN1 is configured as an example of a link member that links the movement of the above-described intermediate transfer belt B according to the movement of the above-described first retracting roll R1 between the above-described first contact position and the above-described first separation position and the movement of the above-described primary transfer roll T1*g* of the G color and the above-described neutralization plate JB together.

Also, the above-described first link LN1 of Embodiment 1 is set in advance such that the amount of movement of the above-described intermediate transfer belt B by the above-described first retracting roll R1, the above-described primary transfer roll T1*g* of the G color, and the like is the same as the amount of movement of the above-described neutralization plate JB.

Also, among the above-described second retracting roll R2, the primary transfer roll T1*o* of the O color disposed on the upstream side of the above-described second retracting roll R2 in the direction of arrow Ya, and the above-described neutralization plate JB, a second link LN2 that is an example of the above-described link member configured in the same manner as the above-described first link LN1 is disposed. Also, among the above-described third retracting roll R3, the primary transfer rolls T1*y* to T1*c* of the YMC colors disposed on the downstream side of the above-described third retracting roll R3 in the direction of arrow Ya, and the above-described neutralization plate JB, a third link LN3 that is an example of the above-described link member configured in the same manner as the above-described links LN1 and LN2 is disposed.

In addition, among the above-described fourth retracting roll R4, the primary transfer roll T1*k* of the K color disposed on the upstream side of the above-described fourth retracting roll R4 in the direction of arrow Ya, and the above-described neutralization plate JB, a fourth link LN4 that is an example of the above-described link member configured in the same manner as the above-described links LN1 to LN3 is disposed.

Since the above-described first link LN1 and the other links LN2 to LN4 have the same configuration, detailed description of the links LN2 to LN4 will be omitted.

(Description of Control Section C of Embodiment 1)

Figure 4:
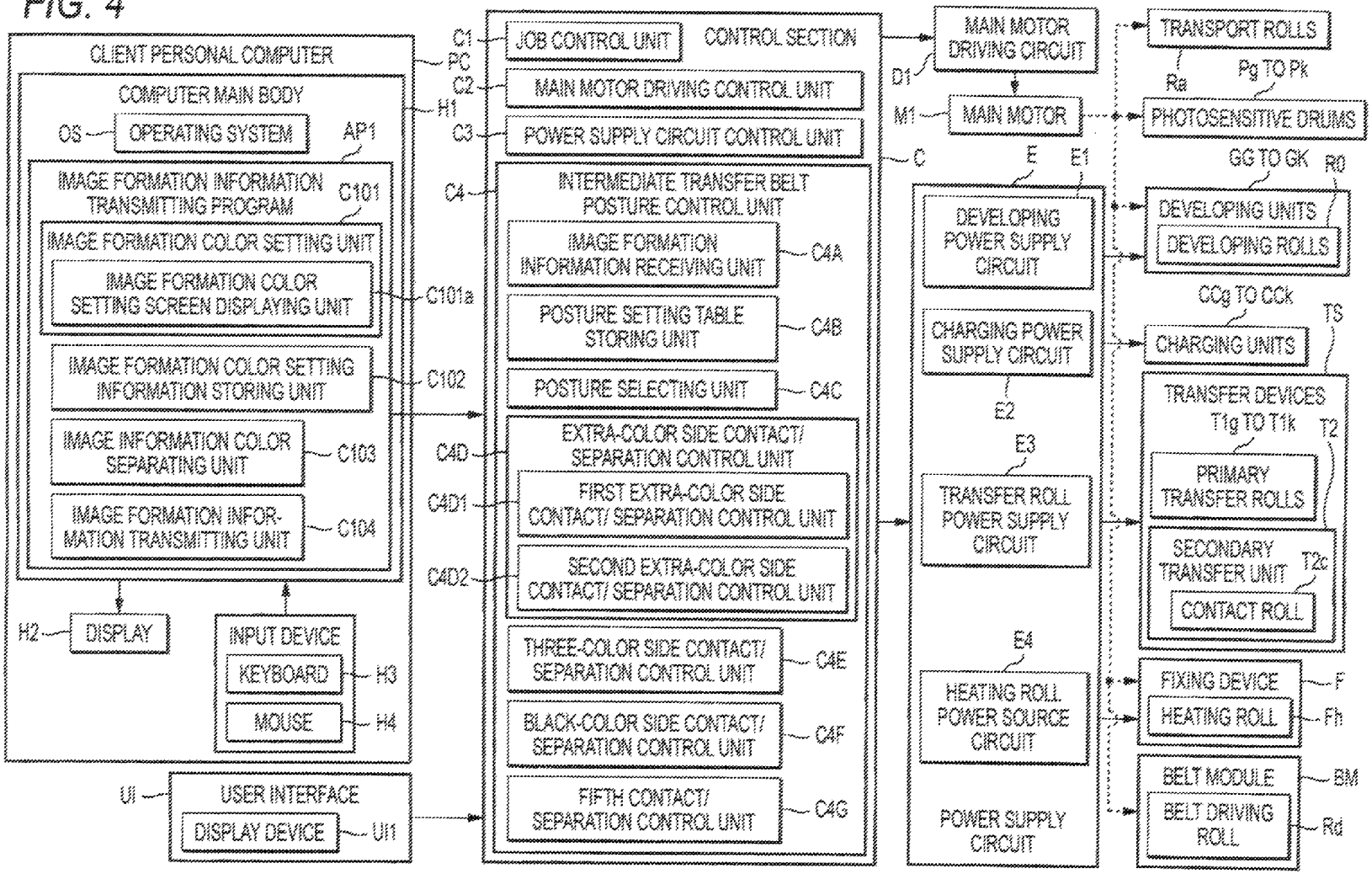
FIG. 4 is a diagram that represents each function included in a control section of the image forming apparatus according to Embodiment 1 of the present invention as a block diagram.

FIG. 4 is a diagram that represents each function included in the control section of the image forming apparatus according to Embodiment 1 of the present invention as a block diagram.

In FIG. 4, the above-described control section C and the control section of the computer main body H1 of the client personal computer PC are configured by: an input-output interface as an example of an input-output signal adjusting unit that performs input-output of signals from or to the outside thereof, adjustment of the input-output signal levels, and the like, that is, a so-called an I/O; a read only memory in which programs, data, and the like for performing necessary processes are stored, that is, a so-called a ROM; a RAM that is for temporarily storing necessary data, that is, a so-called RAM; a central arithmetic processing unit that performs a process according to the program stored in the above-described ROM, that is, a so-called CPU; and a computer as an example of a calculator having a clock oscillator and the like. By executing the programs stored in the above-described ROM, various functions can be realized.

(Description of Control Section of Computer Main Body H1 of Client Personal Computer PC)

In a hard disk drive of the above-described client personal computer PC, basic software, that is, a so-called operating system OS, an image formation information transmitting program AP1 as an application program, and other software not shown in the figure are stored.

(Image Formation Information Transmitting Program AP1)

FIG. 5 is an explanatory diagram of image formation color setting screen according to Embodiment 1 of the present invention.

The control section of the above-described client personal computer PC has the following function implementing units.

C101: Image Formation Color Setting Unit

An image formation color setting unit C101 has an image formation color setting screen displaying unit C101*a* that displays on a display H2 an image formation color setting screen 101 for setting image formation colors that is used when a user performs an image forming operation, that is, a so-called job as shown in FIG. 5, and sets the above-described image formation colors.

In FIG. 5, in the above-described image formation color setting screen 101 according to Embodiment 1, 14 patterns in total is displayed, which include the case where all the six colors of "GOYMCK" are used, the case where five colors of "GYMCK" or "OYMCK" are used, the case where four colors of "YMCK", "GYMC", or "OYMC" are used, the case where three colors of "YMC" are used, the case where two colors of "GO", "GK", or "OK" are used, the case where one color of "G", "O", or "K" is used, and the case of "NONE", that is, the case where any one color is not used. Also, the case where any one color is not used, for example, is a case for adjustment of phases between photosensitive drums, a case for supplying toner to necessary photosensitive drums independently of the intermediate transfer belt, and the like.

Also, the above-described image formation color setting screen 101 has 14 check boxes 101*a* as an example of image formation color selecting buttons corresponding to the above-described 14 patterns. Accordingly, in the above-described image formation color setting screen 101 of Embodiment 1, the user is allowed to select any one from among the total 14 patterns of the image formation colors by using the above-described check box 101*a*.

C102: Image Formation Color Setting Information Storing Unit

An image formation color setting information storing unit C102 stores the above-described image formation colors set by the above-described image formation color setting unit C101, as the above-described image formation color setting information. The above-described image formation color setting information storing unit C102 of Embodiment 1 stores any one of "GOYMCK", "GYMCK", "OYMCK", "YMCK", "GYMC", "OYMC", "YMC", "GO", "GK", "OK", "G", "O", "K", and "NONE" that is selected by using the check box 101*a* of the above-described image formation color setting screen 101 as the above-described image formation color setting information.

C103: Image Information Color Separating Unit

An image formation color separating unit C103 performs color separation for the above-described image information that is an object for which the job is to be executed, based on the above-described image formation color setting information stored in the above-described image formation color setting information storing unit C102. In the case where G: Green and O: Orange as extra colors are included in the above-described image formation color setting information, the above-described image formation color separating unit C103 of Embodiment 1 performs the color separation for the above-described image information so that the use amount of toner of other colors of YMCK becomes the minimum.

C104: Image Formation Information Transmitting Unit

The image formation information transmitting unit C104 transmits to the image forming apparatus U image formation information including the above-described image formation color setting information stored in the above-described image formation color setting information storing unit C102 and the above-described image information in which colors are separated by the above-described image formation color separating unit C103.

(Signal Output Element Connected to Control Section C)

Also, output signals of the following signal output elements such as a UI are input to the above-described control section C.

UI: User Interface

The user interface UI detects an input to the above-described copy start key, the above-described copy number setting key, the above-described numeric keys, the above-described display device UI1, and the like and inputs the detection signal to the control section C.

(Controlled Elements Connected to Control Section C)

The control section C outputs control signals to the following controlled elements D1 and E.

D1: Main Motor Driving Circuit

A main motor driving circuit D1 as an example of a main driving source driving circuit performs rotation driving of the photosensitive drums Pg to Pk, developing rolls RO of developing units GG to GK, the heating roll Fh of a fixing device F, a transport roll Ra, a belt driving roll Rd of a belt module BM, and the like through a gear as an example of a driving force transferring member by driving a main motor M1 as an example of a main driving source.

E: Power Supply Circuit

A power supply circuit E has a developing power supply circuit E1, a charging power supply circuit E2, a transfer roll power supply circuit E3, and a heating roll power supply circuit E4.

E1: Developing Power Supply Circuit

The developing power supply circuit E1 applies developing voltages to the developing rolls RO of the developing units GG to GK.

E2: Charging Power Supply Circuit

The charging power supply circuit E2 applies charging voltages to the charging units CCg to CCk.

E3: Transfer Roll Power Supply Circuit

The transfer roll power supply circuit E3 applies transfer voltages to primary transfer rolls T1*g* to T1*k* and a contact roll T2*c* of a secondary transfer unit T2.

E4: Heating Roll Power Supply Circuit

The heating roll power supply circuit E4 applies heating power to a heater as an example of a heating member of the heating roll Fh of the fixing device F.

(Functions of Control Section C)

The above-described control section C has the following function implementing units that may be implemented by programs for controlling the operations of the controlled elements D1 and E in accordance with the output signals of each signal output element UI.

C1: Job Control Unit

A job control unit C1 as an example of an image forming operation control unit executes a job as an example of an image forming operation by controlling the operations of the latent image forming devices ROSg to ROSk, visible image forming members (UG+GG) to (UK+GK), transfer device TS, a fixing device F, medium transporting device SU, and the like in accordance with the input of the copy start key.

C2: Main Motor Driving Control Unit

A main motor driving control section C2 as an example of a main driving source driving control section controls rotation driving of the photosensitive drums Pg to Pk, the developing rolls RO of the developing units GG to GK, the heating roll Fh of the fixing device F, the transport roll Ra, the belt driving roll Rd, and the like by controlling rotation of the main motor M1 through the main motor driving circuit D1.

C3: Power Supply Circuit Control Unit

A power supply circuit control unit C3 controls supply of voltages and currents to the developing roll RO, the charging units CCg to CCk, the transfer rolls T1*g* to T1*k* and T2*c*, and a heater of the heating roll Fh of the fixing device F, and the like by controlling the operation of the power supply circuit E.

C4: Intermediate Transfer Belt Posture Control Unit

The intermediate transfer belt posture control unit C4 as an example of a movement control unit and an example of an intermediate transfer member posture control unit has: an image formation information receiving unit C4K that receives the above-described image formation information that is transmitted by the above-described image formation information transmitting unit C104; a posture setting table storing unit C4B; a posture selecting unit C4C; a extra-color side contact/separation control unit C4D; a three-color side contact/separation control unit C4E; a black-side contact/separation control unit C4F; and a fifth contact/separation control unit C4G. The intermediate transfer belt posture control unit C4 controls the posture of the above-described intermediate transfer belt B when a job is executed.

FIG. 6 is an explanatory diagram of a posture setting table according to Embodiment 1 of the present invention.

C4B: Posture Setting Table Storing Unit

The posture setting table storing unit C4B as an example of a posture setting information storing unit, as shown in FIG. 6, stores a posture setting table TB as an example of posture setting information for setting the posture of the above-described intermediate transfer belt B corresponding to the above-described image formation color setting information.

In FIG. 6, in the above-described posture setting table TB of Embodiment 1, first posture setting information for moving all the retracting rolls R1 to R5 to respective contact positions in accordance with the case where the above-described image formation color setting information is "GOYMCK" is stored in advance. Also, in the above-described posture setting table TB, second posture setting information for moving the retracting rolls R1 and R3 to R5 to respective contact positions and moving the second retracting roll R2 to the second separation position in accordance with a case where the above-described image formation color setting information is "GYMCK" is stored in advance. Also, in the above-described posture setting table TB, third posture setting information for moving the retracting rolls R2 to R5 to respective contact positions and moving the first retracting roll R1 to the first separation position in accordance with a case where the above-described image formation color setting information is "OYMCK" is stored in advance.

Also, in the above-described posture setting table TB, fourth posture setting information for moving the retracting rolls R3 to R5 to respective contact positions and moving the retracting rolls R1 and R2 to respective separation positions in accordance with a case where the above-described image formation color setting information is "YMCK" is stored in advance. Also, in the above-described posture setting table TB, fifth posture setting information for moving the retracting rolls R1, R3, and R4 to respective contact positions and moving the retracting rolls R2 and R5 to respective separate positions in accordance with a case where the above-described image formation color setting information is "GYMC" is stored in advance. Also, in the above-described posture setting table TB, sixth posture setting information for moving the retracting rolls R2 to R4 to respective contact positions and moving the retracting rolls R1 and R5 to respective separation positions in accordance with a case where the above-described image formation color setting information is "OYMC" is stored in advance. Also, in the above-described posture setting table TB, seventh posture setting information for moving the retracting rolls R3 and R4 to respective contact positions and moving the retracting rolls R1, R2, and R5 to respective separation positions in accordance with a case where the above-described image formation color setting information is "YMC" is stored in advance.

Also, in the above-described posture setting table TB, eight posture setting information for moving the retracting rolls R1 and R2 to respective contact positions and moving the retracting rolls R3 and R5 to respective separate positions in accordance with a case where the above-described image formation color setting information is "GO" is stored in advance.

Also, in the above-described posture setting table TB, ninth posture setting information for moving the retracting rolls R1, R4, and R5 to respective contact positions and moving the retracting rolls R2 and R3 to respective separation positions in accordance with a case where the above-described image formation color setting information is "GK" is stored in advance. Also, in the above-described posture setting table TB, tenth posture setting information for moving the retracting rolls R2, R4, and R5 to respective contact positions and moving the retracting rolls R1 and R3 to respective separate positions in accordance with a case where the above-described image formation color setting information is "OK" is stored in advance.

Also, in the above-described posture setting table TB, eleventh posture setting information for moving the first retracting roll R1 to the first contact position and moving the retracting rolls R2 to R5 to respective separate positions in accordance with a case where the above-described image formation color setting information is "G" is stored in advance. Also, in the above-described posture setting table TB, twelfth posture setting information for moving the second retracting roll R2 to the contact position and moving the retracting rolls R1, R3 to R5 to respective separate positions in accordance with a case where the above-described image formation color setting information is "O" is stored in advance. Also, in the above-described posture setting table TB, thirteenth posture setting information for moving the retracting rolls R4 and R5 to respective contact positions and moving the retracting rolls R1 and R3 to respective separation positions in accordance with a case where the above-described image formation color setting information is "K" is stored in advance. Also, in the above-described posture setting table TB, fourteenth posture setting information for moving all the retracting rolls R1 to R5 to respective contact positions in accordance with a case where the above-described image formation color setting information is "NONE" is stored in advance.

Accordingly, the above-described posture setting information of Embodiment 1 is configured by the above-described first to fourteenth posture setting information.

C4C: Posture Selecting Unit

The posture selecting unit C4C selects the posture of the above-described intermediate transfer belt B at a time when a job is executed based on the image formation color setting information that is included in the image formation information received by the image formation information receiving unit C4A and the above-described posture setting table TB that is stored in the above-described posture setting table storing unit C4B. The above-described posture selecting unit C4C of Embodiment 1 selects the posture of the above-described intermediate transfer belt B at a time when a job is executed by selecting the posture setting information included in the above-described posture setting table TB corresponding to the above-described image formation color setting information.

C4D: Extra-Color Side Contact/Separation Control Unit

The extra-color side contact/separation control unit C4D as an example of a first movement control unit has a first extra-color side contact/separation control unit C4D1 and a second extra-color side contact/separation control unit C4D2. The extra-color side contact/separation control unit C4D controls contact/separation between the above-described photosensitive drums Pg and Po of the extra color GO and the above-described intermediate transfer belt B.

C4D1: First Extra-Color Side Contact/Separation Control Unit

The first extra-color side contact/separation control unit C4D1 as an example of a first movement sub-controller moves the above-described first retracting roll R1 to the above-described first contact position in the case where the above-described green photosensitive drum Pg is used and moves the above-described first retracting roll R1 to the above-described first separation position in the case where the above-described green photosensitive drum Pg is not used.

C4D2: Second Extra-Color Side Contact/Separation Control Unit

The second extra-color side contact/separation control unit C4D2 as an example of a second movement sub-controller moves the above-described second retracting roll R2 to the above-described second contact position in the case where the above-described orange photosensitive drum Po is used and moves the above-described second retracting roll R2 to the above-described second separation position in the case where the above-described orange photosensitive drum Po is not used.

C4E: Three-Color Side Contact/Separation Control Unit

The three-color side contact/separation control unit C4E as an example of a second movement control unit moves the above-described third retracting roll R3 to the above-described third contact position in the case where each of the above-described photosensitive drums Py to Pc of YMC is used and moves the above-described third retracting roll R3 to the above-described third separation position in the case where each of the above-described photosensitive drums Py to Pc is not used.

C4F: Black-Side Contact/Separation Control Unit

The black-side contact/separation control unit C4F as an example of a third movement control unit moves the above-described fourth retracting roll R4 to the above-described fourth contact position in the case where the above-described black photosensitive drums Pk is used and moves the above-described fourth retracting roll R4 to the above-described fourth separation position in the case where the above-described black image carrier is not used.

C4G: Fifth Contact/Separation Control Unit

The fifth contact/separation control unit C4G as an example of a fourth movement control unit moves the above-described fifth retracting roll R5 to the above-described fifth contact position in the case where each of the above-described photosensitive drums Py to Pc of YMC or the above-described black photosensitive drum Pk is used and moves the above-described fifth retracting roll R5 to the above-described fifth separation position in the case where each of the above-described photosensitive drums Py to Pc and the above-described black photosensitive drum Pk are not used.

Accordingly, the above-described intermediate transfer belt posture control unit C4 of Embodiment 1 controls the posture of the above-described intermediate transfer belt B at a time when a job is executed by moving the retracting rolls R1 to R5 between the contact positions and the separation positions in accordance with the posture setting information selected by the above-described posture selecting unit C4C.

With regard to a flow of the process of the image forming apparatus U according to Embodiment 1 of the present invention, there is just a process of moving the retracting rolls R1 to R5 between the contact positions and the separation positions in accordance with the posture setting information, which is included in the posture setting table TB, corresponding to the above-described image formation color setting information in the case where the above-described image formation information transmitted from the image formation information transmitting program AP1 of the above-described client personal computer PC is received. Thus, the flowchart is not shown in the figure, and detailed description thereof will be omitted.

(Operation of Embodiment 1)

In the above-described image forming apparatus U according to Embodiment 1 of the present invention having the above-described configuration, in the case where an image forming operation, that is, a so-called job is executed, electrostatic latent images formed on the surfaces of the photosensitive drums Pg to Pk are developed with toner of the respective colors supplied to the developing rolls RO of the above-described developing units GG to GK. The toner images formed on the surfaces of the photosensitive drums Pg to Pk are primarily transferred sequentially on the above-described intermediate transfer belt B in an overlapping manner in the above-described primary transfer areas Q3*g* to Q3*k* by the above-described primary transfer rolls T1*g* to T1*k*, whereby a color image is formed. Then, the color image formed on the above-described intermediate transfer belt B is transported to the above-described secondary transfer area Q4 and is secondarily transferred to a recording sheet S by the above-described secondary transfer unit T2. In addition, according to the above-described belt module BM of Embodiment 1, on the downstream side of the above-described primary transfer rolls T1*g* to T1*k* in the direction of arrow Ya, the above-described neutralization plate JB having a flat plate shape as an example of the above-described neutralization member is disposed in a non-contact manner. Accordingly, electric charges of the above-described intermediate transfer belt B are neutralized. Accordingly, disturbing or scattering of a toner image formed on the above-described intermediate transfer belt B due to local charging caused by discharging of the primary transfer rolls T1*g* to T1*k* is reduced.

Also, according to the above-described image forming apparatus U of Embodiment 1, in the case where the above-described image formation information transmitted from the above-described client personal computer PC is received, the posture of the intermediate transfer belt B is changed by changing the state of applying the tension to the above-described intermediate transfer belt B. Here, in the specification of this application, the "change the state of applying the tension" described here represents changing of the positions of the above-described belt supporting rolls Rd, Rt, Rt2, Rt3, Rta, Rtb, Rw, Rf, T2*a*, R1 to R5, and T1*g* to T1*k* that apply the tension to the above-described intermediate transfer belt B and changing of the magnitude of the applied tension. Accordingly, the case where the tension is not applied at all by moving the retracting rolls R1 to R5 from the contact positions to the respective separate positions, the case where the applied tension is decreased, and the like are included therein.

Specifically, as shown in FIGS. 5 and 6, the posture setting information, which is included in the posture setting table TB, corresponding to the image formation color setting information included in the received above-described image formation information is selected, and the retracting rolls R1 and R5 are moved between the contact positions and the separation positions in accordance with the selected posture setting information, whereby the posture of the above-described intermediate transfer belt B is changed.

For example, in the case where the above-described image formation color setting information is "GOYMCK", the first posture setting information included in the above-described posture setting table TB is selected, and as shown in FIG. 2, all the retracting rolls R1 to R5 are moved to respective contact positions.

Figure 7:
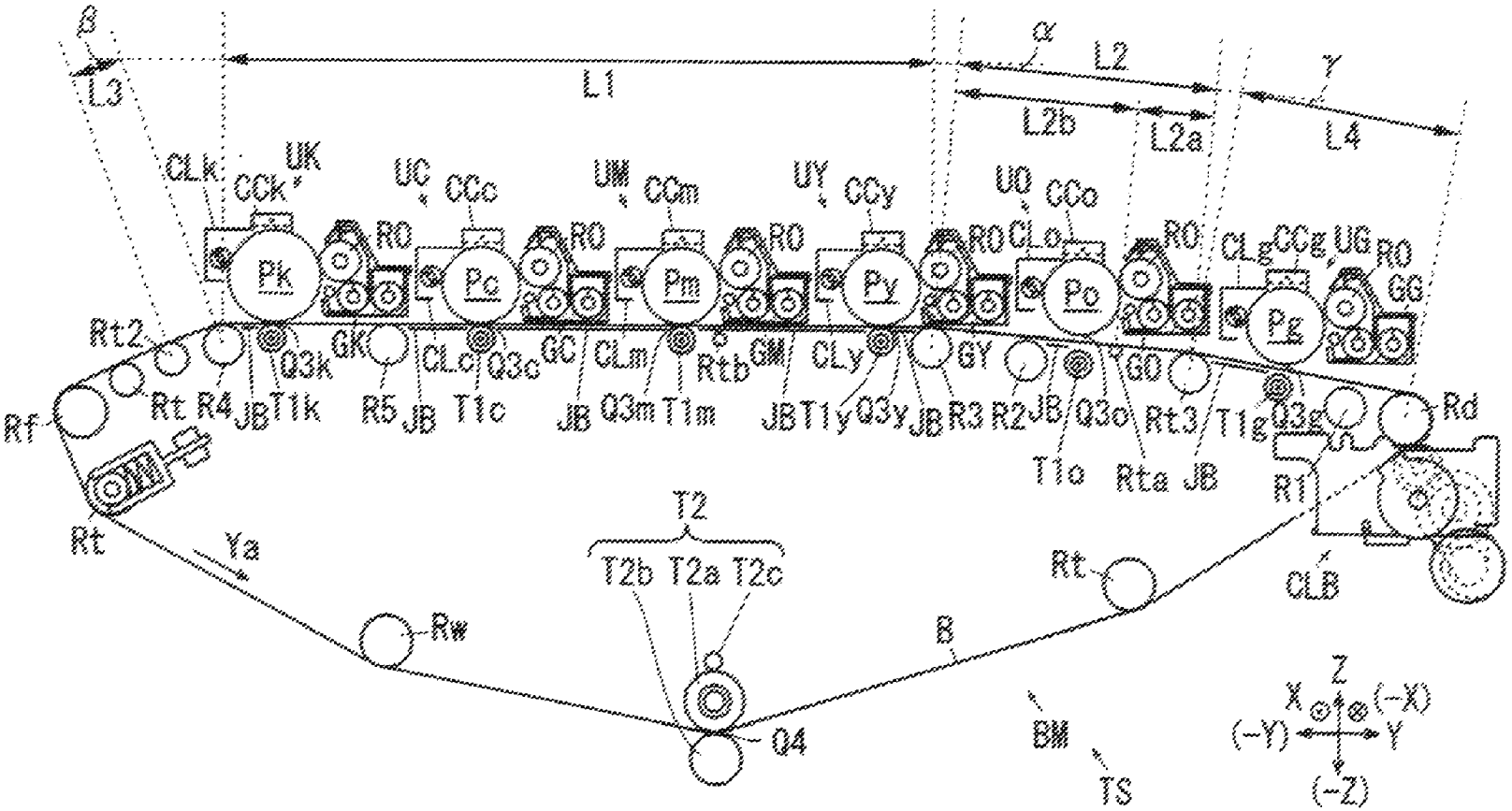
FIG. 7 is an explanatory diagram of the operation of Embodiment 1 of the present invention, is an enlarged explanatory diagram of an example of a change in the posture of the intermediate transfer belt of Embodiment 1, and is an explanatory diagram of a state in which photosensitive drums of G and O colors are separated from the intermediate transfer belt from the state shown in FIG. 2.

FIG. 7 is an explanatory diagram of the operation of Embodiment 1 of the present invention and is an enlarged explanatory diagram of an example of a change in the posture of the intermediate transfer belt of Embodiment 1. Also, FIG. 7 is a state explanatory diagram illustrating that the photosensitive drums of the G and O colors are separated from the intermediate transfer belt in the state shown in FIG. 2.

Figure 8:
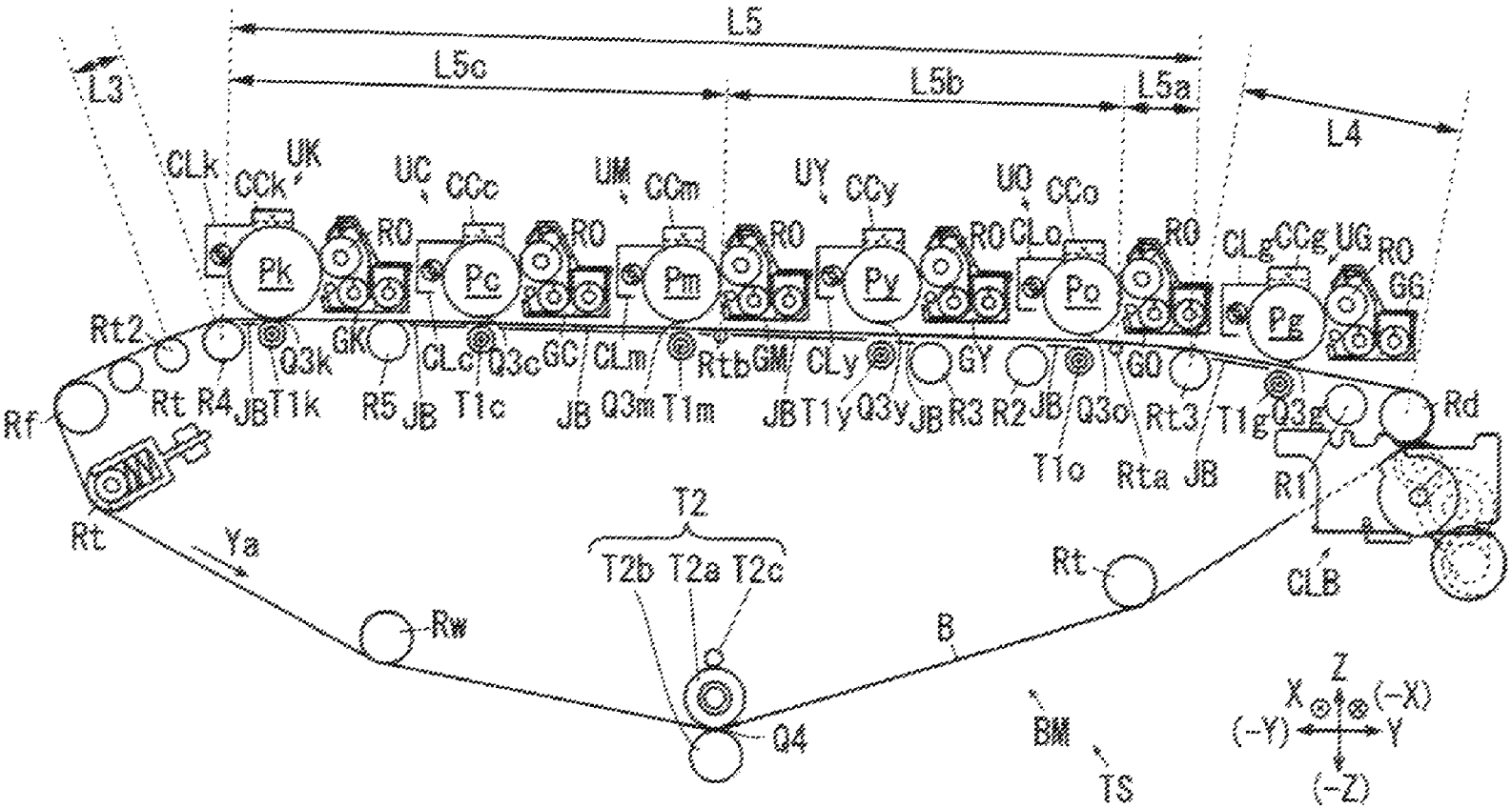
FIG. 8 is an explanatory diagram of the operation of Embodiment 1 of the present invention, is an enlarged explanatory diagram of an example of a change in the posture of the intermediate transfer belt of Embodiment 1, and is an explanatory diagram of a state in which the photosensitive drums of Y, M, and C colors are separated from the intermediate transfer belt from the state shown in FIG. 7.

FIG. 8 is an explanatory diagram of the operation of Embodiment 1 of the present invention and is an enlarged explanatory diagram of an example of a change in the posture of the intermediate transfer belt of Embodiment 1. Also, FIG. 8 is a state explanatory diagram illustrating that the photosensitive drums of the Y, M, and C colors are separated from the intermediate transfer belt in the state shown in FIG. 7.

Figure 9:
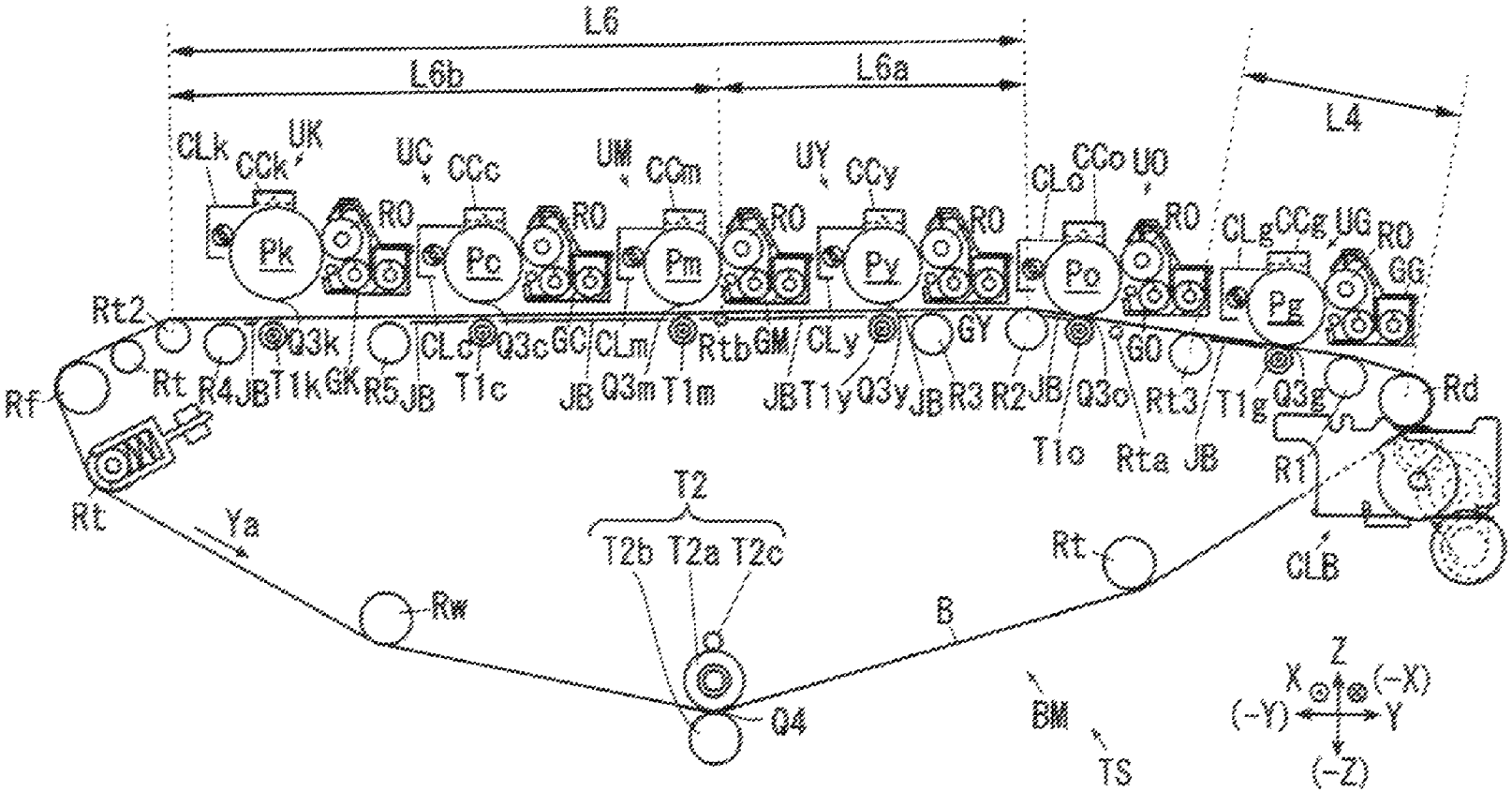
FIG. 9 is an explanatory diagram of the operation of Embodiment 1 of the present invention, is an enlarged explanatory diagram of an example of a change in the posture of the intermediate transfer belt of Embodiment 1, and is an explanatory diagram of a state in which the photosensitive drums of Y, M, C, and K colors are separated from the intermediate transfer belt from the state shown in FIG. 2.

FIG. 9 is an explanatory diagram of the operation of Embodiment 1 of the present invention and is an enlarged explanatory diagram of an example of a change in the posture of the intermediate transfer belt of Embodiment 1. Also, FIG. 9 is a state explanatory diagram illustrating that the photosensitive drums of the Y, M, C, and K colors are separated from the intermediate transfer belt in the state shown in FIG. 2.

Also, in the case where the image formation color setting information included in the above-described image formation information that is received is "YMCK", the fourth posture setting information included in the above-described posture setting table TB is selected, and as shown in FIG. 7, the retracting rolls R1 and R2 are moved to the respective separation positions. Also, in the case where the above-described image formation color setting information is "K", the 13th posture setting information included in the above-described posture setting table TB is selected, and as shown in FIG. 8, the retracting rolls R1 to R3 are moved to the respective separation positions. Also, in the case where the image formation color setting information included in the above-described image formation information that is received is "GO", the eighth posture setting information included in the above-described posture setting table TB is selected, and as shown in FIG. 9, the retracting rolls R3 to R5 are moved to the respective separation positions.

Accordingly, in Embodiment 1, in the case where a so-called six-color mode, four-color mode, monochrome mode, or the like is used, the photosensitive drums Pg to Pk that are not used are separated from the intermediate transfer belt B. Therefore, according to the image forming apparatus U of Embodiment 1, the temporal deterioration such as wearing of each of the above-described members Pg to Pk and B is reduced. In particular, in Embodiment 1, as shown in FIG. 5, a total of 14 patterns including one type of the six-color mode, two types of the five-color mode, three types of the four-color mode, one type of the three-color mode, three types of the two-color mode, three types of the one-color mode, and one type of the zero-color mode are used. Therefore, according to the image forming apparatus U of Embodiment 1, the posture of the intermediate transfer belt B is changed to 14 types in accordance with the patterns of the total of 14 types. Accordingly, the temporal deterioration such as wearing of each of the above-described members Pg to Pk and B is effectively reduced. In other words, according to the image forming apparatus U of Embodiment 1, the photosensitive drums Pg to Pk that are not used for image formation are separated from the above-described intermediate transfer belt B. Accordingly, abrasion due to the contact of the members Pg to Pk and B that are not used when an image is formed can be prevented. Therefore, compared to the case where the members Pg to Pk and B are brought into contact all the time, the temporal deterioration of the members Pg to Pk and B is reduced.

Also, according to Embodiment 1, in the case where the retracting rolls R1 to R5 are moved to respective separation positions, the retracting rolls R1 to R5 are separated from the above-described intermediate transfer belt B, and the corresponding primary transfer rolls T1*g* to T1*k* and the above-described neutralization plates JB are simultaneously separated by the links LN1 to LN4 shown in FIG. 4. Therefore, according to the above-described image forming apparatus U of Embodiment 1, the temporal deterioration such as wearing of the above-described intermediate transfer belt B is further reduced.

Also, as shown in FIGS. 7 to 9, in the case where the three three-color photosensitive drums Py, Pm, and Pc of YMC are not used, the three-color photosensitive drums Py to Pc are simultaneously separated by moving the third retracting roll R3 to the third separation position. Therefore, according to the above-described image forming apparatus U of Embodiment 1, a mechanism that allows contact/separation of the photosensitive drums Py to Pc of YMC is commonly used. Accordingly, the number of components can be decreased.

Also, in Embodiment 1, as shown in FIG. 2, it is set in advance such that the first segment L1 extending along the outer surface of the above-described intermediate transfer belt B from the above-described third retracting roll R3 to the fourth retracting roll R4 is in the shape of a straight line. In other words, according to Embodiment 1, in the above-described intermediate transfer belt B, the primary transfer areas Q3*g* to Q3*k* of YMCK, in which the precision of transfer positions and transfer timings of the primary transfer, that is, the precision of so-called color registration is particularly required, are in the shape of a straight line.

As a result, according to the above-described image forming apparatus U of Embodiment 1, compared to the case where the above-described first segment L1 is not in the shape of a straight line, the precision of color registration can be improved. Accordingly, a high-quality color image can be formed in an easy manner.

Also, in Embodiment 1, the visible image forming members (UY+GY) to (UK+GK) of YMCK colors can be arranged in one line. Accordingly, all the visible image forming members (UY+GY) to (UK+GK) can be arranged in the same shape and in the same state. Accordingly, in the image forming apparatus U of Embodiment 1, the components of the above-described visible image forming members (UY+GY) to (UK+GK) can be commonly used. Therefore, the manufacturing cost of the whole image forming apparatus U can be reduced.

Also, also for extra colors of GO for which the precision of color registration as high as being required for the colors of YMCK is not required, by decreasing the above-described first angle α shown in FIG. 2 that is an angle formed between the above-described first segment and a second segment L2 extending along the outer surface of the above-described intermediate transfer belt B from the above-described third intermediate transfer body supporting member Rt3 to the above-described third retracting roll R3 to be as small as possible so as to be in a state close to parallel alignment, the components of the visible image forming members (UG+GG) and (UO+GO) of GO can be commonly used. For example, in the case where the above-described first angle α is equal to or smaller than 1.6°, even when the visible image forming members (UG+GG) and (UO+GO) of GO are configured and arranged to have the same shape as the visible image forming members (UY+GY) to (UK+GK) of YMCK, the visible image forming members can be attached to or detached from the front and rear sides without interfering the above-described intermediate transfer belt BM.

Also, by setting the above-described angles α, β, and (α+γ) shown in FIG. 2 to be decreased to be as small as possible, the height of the above-described intermediate transfer belt B in the vertical direction can be decreased. In this case, the height in the vertical direction from the lower end of the above-described belt module BM to the upper end of each of the visible image forming members (UG+GG) to (UK+GK) can be decreased. Accordingly, the entire height of the above-described image forming apparatus U can be decreased.

Also, in this case, even when the length in the vertical direction between the contact position and the separation position of each of the above-described first retracting rolls R1 to R5 is set to be small, the posture of the above-described intermediate transfer belt B can be changed into all the 14 patterns without bringing the above-described members R1 to R5, T1*g* to T1*k*, and JB into contact with the above-described intermediate transfer belt B. Accordingly, the change in the posture is decreased.

Also, when the change in the posture is decreased, a change in the amount of meandering of the above-described intermediate transfer belt B that is changed in accordance with changes in the winding rolls (Rd, Rt, Rt2, Rt3, Rta, Rtb, Rw, Rf, T2*a*, R1 to R5, T1*g* to T1*k*, and T2*a*) around which the above-described intermediate transfer belt B is wound is decreased. Therefore, according to the image forming apparatus U of Embodiment 1, an increase in the meandering due to the change in the posture can be decreased.

Also, according to the above-described image forming apparatus U of Embodiment 1 of the present invention having the above-described configuration, the photosensitive drums Pg and Po of the above-described extra colors are disposed on the upstream side of the photosensitive drums Py to Pk of YMCK in the direction of Ya. In other words, in the end portion of the upstream side in the direction of Ya, the extra color photosensitive drums Pg and Po are disposed. Also, in the end portion of the downstream side in the direction of Ya, the above-described black photosensitive drum Pk is disposed. Also, in Embodiment 1, three types of the one-color mode of "G", "O", and "K" correspond to single color printing, that is, a so-called monochrome mode, and as reference colors for the single color printing, three colors of G: Green, O: Orange, and K: Black are set.

Therefore, according to the above-described image forming apparatus U of Embodiment 1, the photosensitive drums Pg, Po, and Pk for reference colors are disposed in two or more places, and the single color printing of each reference color can be set.

Also, into each of the developing units GG and GO of the visible image forming members (UG+GG) and (UO+GO) for the above-described extra colors, arbitrary toner other than the toner of G: Green and O: Orange can be introduced. Thus, for example, colorless clear toner or the like can be introduced therein. Also, for example, a color symbolizing an organization such as a company or a group as an example of a user, that is, a so-called corporate color can be introduced. Accordingly, in the case where an image of a corporate color is formed, compared to the case where the image of the corporate color is formed by using four colors of YMCK, image defection such as deterioration of coloring or color developing is reduced.

Also, in Embodiment 1, in the above-described client personal computer PC, in the case where GO is included in the above-described image formation color setting information, the above-described image information is separated for each color so as to minimize the use amount of toner of other colors of YMCK. Accordingly, for example, in the case where GO are corporate colors, and images of the corporate colors are formed on a massive scale, compared to the case where printing is performed by using four colors of YMCK all the time, the use amount of toner of YMCK is reduced.

Also, according to Embodiment 1, in order to change the posture of the above-described intermediate transfer belt B so that the photosensitive drums Pg to Pk that are not used are separated therefrom, three fixed rolls Rd, Rt2 and Rt3 and five movable rolls R1 to R5 are disposed in the positions shown in FIGS. 2 and 7 to 9 in advance. In other words, in Embodiment 1, the rolls are disposed in order of the segments of L4: Rd, R1, and Rt3, L2: Rt3, R2, and R3, L1: R3, R5, and R4, and L3: R4 and Rt2 along the direction of Ya. Also, the rolls Rd, Rt2, Rt3, and R1 to R5 are disposed in advance in the state in which the segments L4, L2, and L3 are inclined to the lower side by angles ($\alpha+\gamma$), $\alpha$, and $\beta$ with respect to the first segment L1. Accordingly, for example, when the posture setting information corresponding to "GYMCK", "GYMC", "GK", or "OK" is selected, in other words, even in the case where the posture is changed to the state in which the photosensitive drums P0 and Py to Pc disposed in the center portion in the direction of Ya are not used, that is, a so-called disintermediated state, by only moving the retracting rolls R1 to R5, the above-described intermediate transfer belt B can be separated from the photosensitive drums Po, Py to Pc.

Thus, in the above-described image forming apparatus U of Embodiment 1, the above-described belt module BM is configured by the number of components Rd, R1, Rt3, R2, R3, R5, R4, and Rt2 that is the minimum for implementing color settings of the total of 14 patterns shown in FIG. 5 based on the posture setting information of 14 types shown in FIG. 6 and the setting values L1 to L4, $\alpha$, $\beta$, and $\gamma$. As a result, according to the above-described image forming apparatus U of Embodiment 1, compared to the case where the segments L4, L2, and L3 are not inclined to the lower side with respect to the first segment L1, the number of the components is decreased. Accordingly, the manufacturing cost of the whole image forming apparatus U is decreased.

Also, according to Embodiment 1, as shown in FIG. 7, in the case where the above-described second retracting roll R2 is moved to the second separation position, the above-described members R2, T1*o*, and JB are separated from the above-described intermediate transfer belt B by the second link LN2, and the first separation-time winding roll Rta is brought into contact with the above-described intermediate transfer belt B when the above-described first disposed in the first separation-time contact position is separated. Accordingly, in the above-described image forming apparatus U of Embodiment 1, compared to the case where the above-described first separation-time winding roll Rta is not disposed, a length of the above-described intermediate transfer belt B that is not supported by the winding rolls, that is, a so-called free length is shortened. In other words, as shown in FIG. 7, the free length for the case where there is no first separation-time winding roll Rta described above becomes a length L2 between the winding rolls Rt3 and R2. On the other hand, the free lengths for the case where there is the first separation-time roll Rta become a length L2*a* between the winding rolls Rt3 and Rta and a length L2*b* between the winding rolls Rta and R2, which is relatively short.

Figure 10:
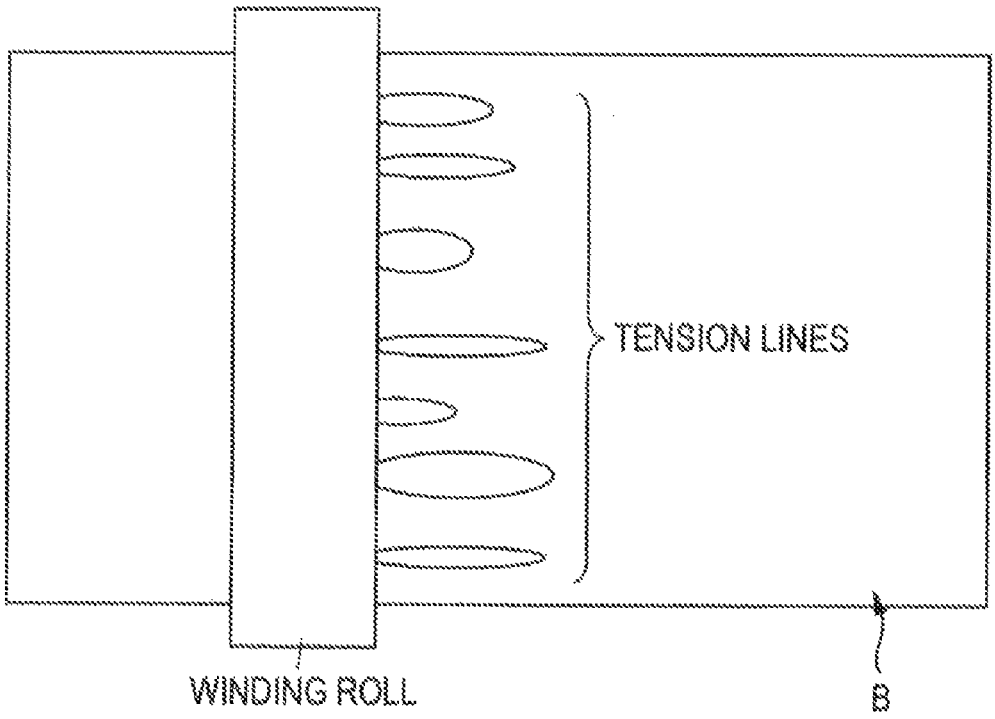
FIG. 10 is an explanatory diagram of the operation of Embodiment 1 of the present invention and is an enlarged explanatory diagram of tension lines generated in the intermediate transfer belt.

FIG. 10 is an explanatory diagram of the operation of Embodiment 1 of the present invention and is an enlarged explanatory diagram of tension lines generated in the intermediate transfer belt.

Here, as shown in FIG. 10, as the above-described free length is increased, the intermediate transfer belt B may be easily curved along the width direction thereof in a wavelike pattern, and a phenomenon of generating variations in gaps between the above-described intermediate transfer belt B and the photosensitive drums Pg to Pk before winding the winding rolls, that is, generation of so-called tension lines can easily occur.

On the other hand, the above-described image forming apparatus U of Embodiment 1, compared to the case where the above-described first separation-time winding roll Rta is not provided, the free lengths L2*a* and L2*b* of the above-described second segment L2 are decreased. Accordingly, generation of wrinkles in the direction of Ya, which may be generated due to an increase in the gap between the winding rolls, that is, so-called tension lines is reduced. As a result, according to the above-described image forming apparatus U of Embodiment 1, compared to the case where the above-described first separation-time winding roll Rta is not provided, generation of wrinkles, that is, tension lines generated in the above-described intermediate transfer belt B in accordance with a change in the state of the tension applied to the above-described intermediate transfer belt B is suppressed. Accordingly, deterioration of an image such as a transfer defect that is accompanied with generation of the above-described tension lines is reduced.

Also, in Embodiment 1, as shown in FIG. 8, in the case where the retracting rolls R2 and R3 are moved to the respective separation positions, the members R2, R3, T1*o* to T1*c*, and JB are separated from the intermediate transfer belt B by the links LN2 and LN3, and the separation-time winding rolls Rta and Rtb disposed in respective separation-time contact positions are brought into contact with the intermediate transfer belt B. Accordingly, as shown in FIG. 8, the free length in the case where there is no separation-time winding rolls Rta and Rtb described above becomes the length L5=L1+L2 between the winding rolls Rt3 and Rt4. On the other hand, the free lengths in the case where there are the separation-time winding rolls Rta and Rtb become the length L5*a*=L2*a* between the winding rolls Rt3 and Rta, the length L5*b* between the winding rolls Rta and Rtb, and the length L5*c* between the winding rolls Rtb and R4, which are shortened. Therefore, according to the above-described image forming apparatus U of Embodiment 1, compared to the case where the separation-time winding rolls Rta and Rtb are not provided, the free length L5*a* to L5*c* is divided to be shortened, whereby generation of tension lines is reduced.

Also, according to Embodiment 1, as shown in FIG. 9, even in the case where the second retracting roll R2 is moved to the second contact position, and the retracting rolls R3 to R5 are moved to the respective separation positions, the members R3 to R5, T1*o* to T1*c*, and JB are separated from the intermediate transfer belt B by the links LN3 to LN4, and the second separation-time winding roll Rtb disposed in the above-described second separation-time contact position is brought into contact with the intermediate transfer belt B. Accordingly, as shown in FIG. 9, the free length in the case where there is no second separation-time winding roll Rtb described above becomes the length L6 between the winding rolls R2 and Rt2. On the other hand, the free lengths in the case where there is the second separation-time winding roll Rtb become the length L6*a* between the winding rolls R2 and Rtb and the length L6*b* between the winding rolls Rtb and Rt2, which are shortened. Thus, according to the above-described image forming apparatus U of Embodiment 1, compared to the case where the second separation-time winding roll Rtb is not provided, the free length is divided L6*a* and L6*b* so as to be shortened, whereby generation of tension lines is reduced.

As a result, according to the image forming apparatus U of Embodiment 1, compared to the case where the above-described separation-time winding rolls Rta and Rtb are not provided, generation of tension lines that is accompanied with a change in the state of the tension applied to the above-described intermediate transfer belt B is suppressed. Accordingly, deterioration of an image such as a transfer defect that is accompanied with generation of the above-described tension lines is reduced. Particularly in the case where there is the above-described second separation-time winding roll Rtb, the increase in the free length on the upstream side of the second separation-time winding roll Rtb in the direction of Ya and the downstream side in the direction of Ya is suppressed. Accordingly, the above-described image deterioration accompanied with generation of tension lines on the upstream side in the direction of Ya and the downstream side in the direction of Ya is reduced.

Embodiment 2

Next, Embodiment 2 of the present invention will be described. In the description of Embodiment 2, to each constituent element corresponding to the constituent element of the above-described Embodiment 1, the same reference sign is assigned, and detailed description thereof will be omitted.

Although this Embodiment 2 is different from the above-described Embodiment 1 in the following points, the other points are configured to be the same as those of Embodiment 1.

Figure 11:
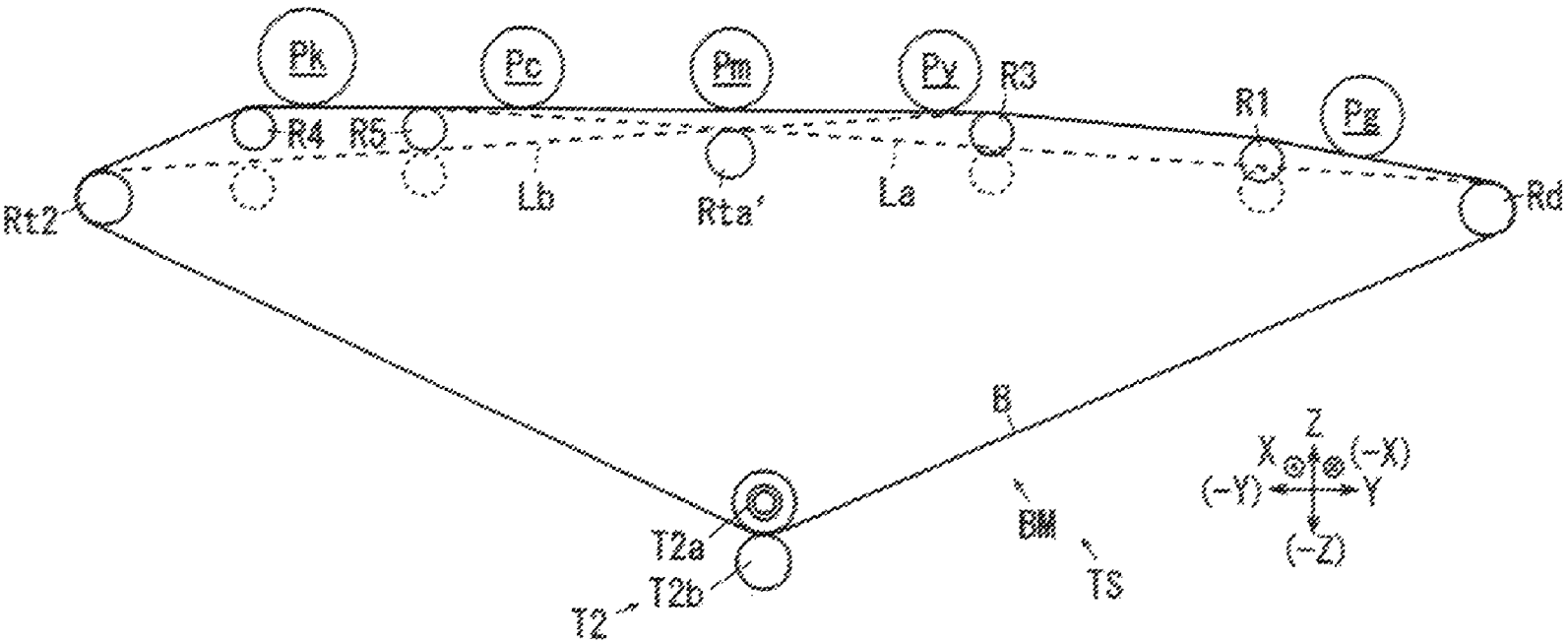
FIG. 11 is an enlarged explanatory diagram of a major part of a belt module according to Embodiment 2 of the present invention, which corresponds to FIG. 2 of Embodiment 1.

FIG. 11 is an enlarged explanatory diagram of a major part of a belt module according to Embodiment 2 of the present invention, which corresponds to FIG. 2 of Embodiment 1.

In FIG. 11, in the image forming apparatus U of Embodiment 2, the latent image forming device ROSo of O: Orange, the visible image forming member (UO+GO), the primary transfer roll T1*o*, the primary transfer area Q3*o*, the neutralization plate JB, the above-described second retracting roll R2, and the above-described second link LN2 are omitted from the configuration of Embodiment 1. In other words, while Embodiment 1 is configured so as to develop six colors at maximum, Embodiment 2 is configured to develop five colors at maximum.

Also, in Embodiment 2, the above-described third intermediate transfer body supporting member Rt3 of Embodiment 1 is omitted, and a separation-time winding roll Rta' as an example of the third tension applying member, by which the separation-time winding rolls Rta and Rtb are replaced, is disposed on the lower side of the magenta photosensitive drum Pm.

The separation-time winding roll Rta' of Embodiment 2, as denoted by a broken line of FIG. 11, is disposed in advance in the position of intersection between a first segment La connecting a driving roll Rd that is fixedly supported and a fifth retracting roll R5 located in the fifth contact position and a second segment Lb connecting a third retract roll R3 located in the third contact position and a secondary intermediate transfer body supporting member Rt2 that is fixedly supported.

(Description of Control Section C of Embodiment 2)

Figure 12:
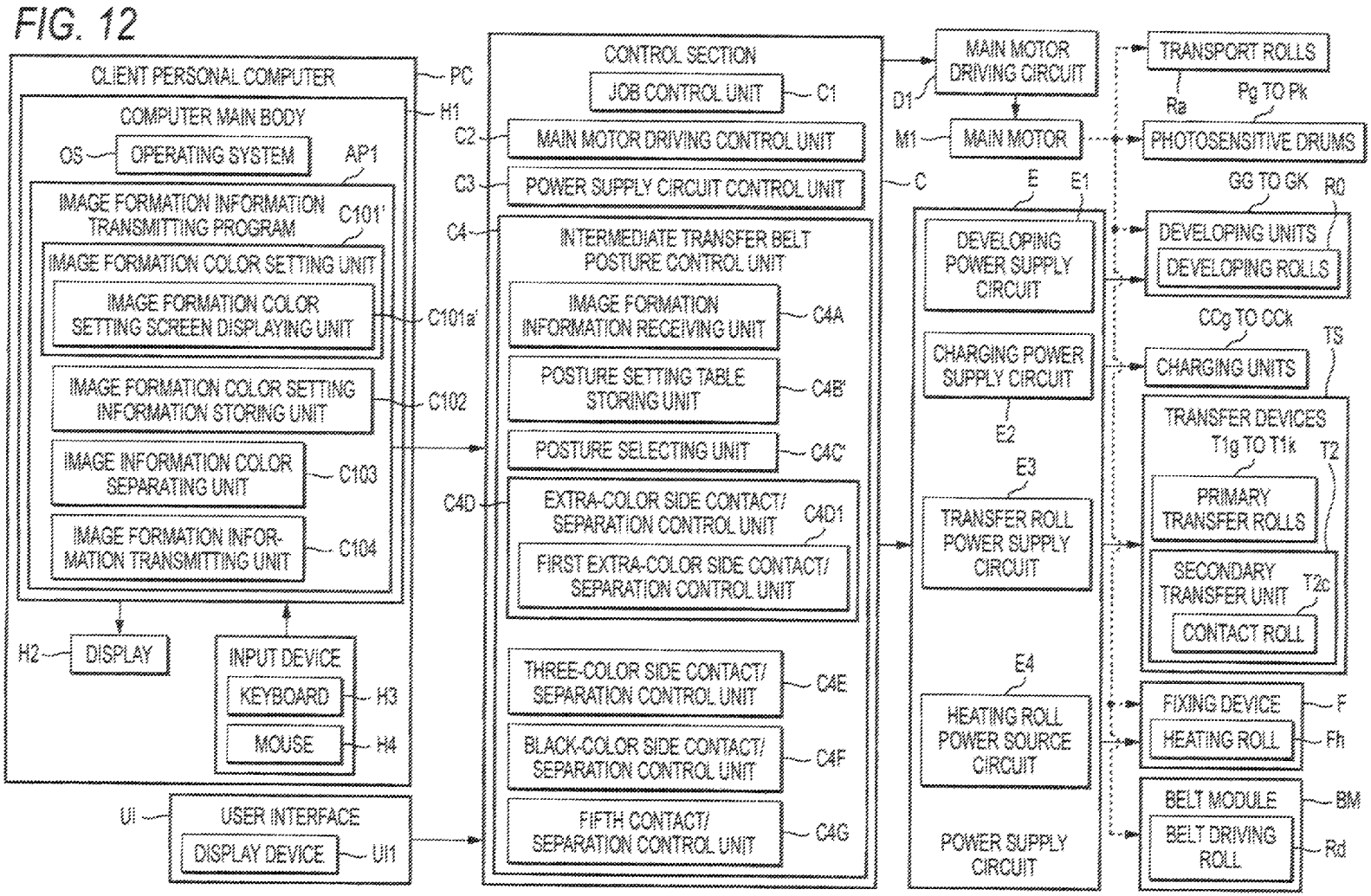
FIG. 12, which corresponds to FIG. 4 of Embodiment 1, is a diagram that represents each function included in a control section of an image forming apparatus according to Embodiment 2 of the present invention as a block diagram.

FIG. 12, which corresponds to FIG. 4 of Embodiment 1, is a diagram that represents each function included in the control section of the image forming apparatus according to Embodiment 2 of the present invention as a block diagram.

FIG. 13, which corresponds to FIG. 5 of Embodiment 1, is an explanatory diagram of an image formation color setting screen according to Embodiment 2 of the present invention.

As shown in FIG. 12, an image formation information transmitting program AP1 of a client personal computer PC of Embodiment 2 has an image formation color setting unit C101' replacing the image formation color setting unit C101.

C101': Image Formation Color Setting Unit

The image formation color setting unit C101' has an image formation color setting screen displaying unit C101*a*' that displays an image formation color setting screen 101', shown in FIG. 13, in a display H2 and sets the above-described image formation colors.

In FIG. 13, in the above-described image formation color setting screen 101' according to Embodiment 2, a total of eight patterns is displayed, which includes the case where all the five colors of "GYMCK" are used, the case where four colors of "GYMC" or "YMCK" are used, the case where three colors of "YMC" are used, a case where two colors of "GK" are used, the case where one color of "G" or "K" is used, and the case of "NONE", that is, the case where any one color is not used. Also, the above-described image formation color setting screen 101' has eight check boxes 101*a*', which is similar to the check boxes 101*a* of Embodiment 1, as an example of image formation color selecting buttons corresponding to the above-described eight patterns.

FIG. 14, which corresponds to FIG. 6 of Embodiment 1, is an explanatory diagram of a posture setting table according to Embodiment 2 of the present invention.

Also, as shown in FIG. 12, the control section C of Embodiment 2 has a posture setting table storing unit C4B' and a posture selecting unit C4C', by which the above-described posture setting table storing unit C4B and the posture selecting unit C4C are replaced. Also, in the above-described control section C, the above-described second extra-color side contact/separation control unit C4D2 corresponding to the omitted second retracting roll R2 is omitted.

C4B': Posture Setting Table Storing Unit

A posture setting table storing unit C4B' as an example of a posture setting information storing unit stores a posture setting table TB' shown in FIG. 14.

As shown in FIG. 14, in the above-described posture setting table TB' of Embodiment 2, first posture setting information for moving all the retracting rolls R1 to R5 to respective contact positions in accordance with the case where the above-described image formation color setting information is "GYMCK" is stored in advance. Also, in the above-described posture setting table TB', second posture setting information for moving the retracting rolls R3 to R4 to respective contact positions and moving the first retracting roll R1 to the first separation position in accordance with a case where the above-described image formation color setting information is "YMCK" is stored in advance. Also, in the above-described posture setting table TB', third posture setting information for moving the retracting rolls R1, R3, and R4 to respective contact positions and moving the fifth retracting roll R5 to a fifth separation position in accordance with a case where the above-described image formation color setting information is "GYMC" is stored in advance.

Also, in the above-described posture setting table TB', fourth posture setting information for moving the retracting rolls R3 and R4 to respective contact positions and moving the retracting rolls R1 and R5 to respective separation positions in accordance with a case where the above-described image formation color setting information is "YMC" is stored in advance. Also, in the above-described posture setting table TB', fifth posture setting information for moving the retracting rolls R1, R4, and R5 to respective contact positions and moving the third retracting roll R3 to a third separation position in accordance with a case where the above-described image formation color setting information is "GK" is stored in advance.

Also, in the above-described posture setting table TB', sixth posture setting information for moving the retracting rolls R4 and R5 to respective contact positions and moving the retracting rolls R1 and R3 to respective separation positions in accordance with a case where the above-described image formation color setting information is "K" is stored in advance. Also, in the above-described posture setting table TB', seventh posture setting information for moving the first retracting roll R1 to the contact position and moving the retracting rolls R3 to R5 to respective separation positions in accordance with a case where the above-described image formation color setting information is "G" is stored in advance.

Furthermore, in the above-described posture setting table TB', eighth posture setting information for moving all the retracting rolls R1 to R5 to respective separation positions in accordance with a case where the above-described image formation color setting information is "NONE" is stored in advance.

Accordingly, the above-described posture setting information of Embodiment 2 is configured by the above-described first to eighth posture setting information.

C4C': Posture Selecting Unit

A posture selecting unit C4C' of Embodiment 2 selects the posture of the above-described intermediate transfer belt B at a time when a job is executed by selecting the posture setting information, which corresponds to the image formation color setting information included in the image formation information received by the image formation information receiving unit C4A, included in the above-described posture setting table TB' that is stored in the above-described posture setting table storing unit C4B'.

(Operation of Embodiment 2)

In the above-described image forming apparatus U according to Embodiment 2 of the present invention having the above-described configuration, as shown in FIG. 11, the above-described separation-time retracting roll Rta' is disposed in the position of intersection between a first separation segment La formed between the above-described members Rd and R5 and a second separation segment Lb formed between the above-described members R3 and Rt2. Accordingly, the above-described separation-time winding roll Rta' of Embodiment 2 can be assuredly wound by the above-described intermediate transfer belt B in the case where the above-described third retracting roll R3 is moved to the third contact position and the retracting rolls R4 and R5 are moved to the respective separation positions and in the case where the fifth retracting roll R5 is moved to the fifth contact position and the above-described retracting rolls R1 and R3 are moved to the respective separation positions. In other words, according to Embodiment 2, the separation-time winding roll Rta' located in the position of the above-described intersection can be assuredly brought into contact with the above-described intermediate transfer belt B in any of the case where the posture of the above-described intermediate transfer belt B is changed in accordance with lowering the upstream side of the above-described intermediate transfer belt B in the direction of Ya and in the case where the posture of the above-described intermediate transfer belt B is changed in accordance with lowering the downstream side of the above-described intermediate transfer belt B in the direction of Ya.

Here, for example, in the case where the separation-time winding roll Rta' is disposed on the upstream side of the position of the intersection in the direction of Ya, a free length between the winding rolls Rta' and Rt2, which are fixedly supported, at a time when the posture of the above-described intermediate transfer belt B is changed in accordance with lowering of the downstream side in the direction of Ya is longer than that between the winding rolls Rd and Rta', which are fixedly supported, at a time when the posture of the above-described intermediate transfer belt B is changed in accordance with lowering of the upstream side in the direction of Ya. On the contrary, for example, in the case where the separation-time winding roll Rta' is disposed on the downstream side of the position of the intersection in the direction of Ya, a free length between the winding rolls Rd and Rta' at a time when the posture of the above-described intermediate transfer belt B is changed in accordance with lowering of the upstream side in the direction of Ya is longer than that between the winding rolls Rta' and Rt2 at a time when the posture of the above-described intermediate transfer belt B is changed in accordance with lowering of the downstream side in the direction of Ya.

On the other hand, according to Embodiment 2, since the separation-time winding roll Rta' is disposed in the position of the intersection, the free lengths between the winding rolls (Rd and Rta') and between the winding rolls (Rta' and Rt2) that are fixedly supported are not too long in the case where the posture of the above-described intermediate transfer belt B is changed in accordance with lowering of the upstream side in the direction of Ya and in the case where the posture of the above-described intermediate transfer belt B is changed in accordance with lowering of the downstream side in the direction of Ya, compared to the case where the separation-time winding roll Rta' is not disposed in the position of the intersection.

Therefore, according to the above-described image forming apparatus U of Embodiment 2, in any of the case where the posture of the above-described intermediate transfer belt B is changed in accordance with lowering of the upstream side in the direction of Ya and the case where the posture of the above-described intermediate transfer belt B is changed in accordance with lowering of the downstream side in the direction of Ya, an increase in the above-described free length is reduced. Accordingly, generation of the above-described tension lines shown in FIG. 10 is reduced.

Also, for example, when the separation-time winding roll Rta' is disposed on the upstream side of the position of the intersection in the direction of Ya, the tension applied to the above-described intermediate transfer belt B by the above-described separation-time winding roll Rta' in the case where the posture of the above-described intermediate transfer belt B is changed in accordance with lowering of the upstream side in the direction of Ya is stronger than that in the case where the posture of the above-described intermediate transfer belt B is changed in accordance with lowering of the downstream side in the direction of Ya. To the contrary, for example, when the separation-time winding roll Rta' is disposed on the downstream side of the position of the intersection in the direction of Ya, the tension applied to the above-described intermediate transfer belt B by the above-described separation-time winding roll Rta' in the case where the posture of the above-described intermediate transfer belt B is changed in accordance with lowering of the downstream side in the direction of Ya is stronger than that in the case where the posture of the above-described intermediate transfer belt B is changed in accordance with lowering of the upstream side in the direction of Ya.

On the other hand, according to Embodiment 2, since the separation-time winding roll Rta' is disposed at the position of the intersection, the tension applied to the above-described intermediate transfer belt B by the separation-time winding roll Rta' can be uniform between the case where the posture of the above-described intermediate transfer belt B is changed in accordance with lowering of the upstream side in the direction of Ya and the case where the posture of the above-described intermediate transfer belt B is changed in accordance with lowering of the downstream side in the direction of Ya.

Therefore, according to the above-described image forming apparatus U of Embodiment 2, in any of the case where the posture of the above-described intermediate transfer belt B is changed in accordance with lowering of the upstream side in the direction of Ya and the case where the posture of the above-described intermediate transfer belt B is changed in accordance with lowering of the downstream side in the direction of Ya, the tension due to the above-described separation-time winding roll Rta' is increased. Accordingly, bias of the tension distribution of the entire intermediate transfer belt B is decreased.

Furthermore, the image forming apparatus U of Embodiment 2 capable of a maximum of five-color development has the same advantages as those of the image forming apparatus U of Embodiment 1 capable of a maximum of six-color development.

Modified Examples

As presented above, embodiments of the present invention have been described in detail. However, the present invention is not limited to the above-described embodiments, and various changes can be made therein within the scope of the concept of the present invention defined as claims. Modified examples (H01) to (H013) of the present invention will be described below as examples.

(H01) In the above-described embodiments, the above-described image forming apparatus U is configured by a so-called multi-functional device. However, the present invention is not limited thereto, and the image forming apparatus can be configured, for example, by a printer, a facsimile, or the like.

(H02) In the above-described embodiments, the above-described image forming apparatus U is not limited to the configuration in which toner of five colors or six colors is used. For example, a configuration in which toner of four colors or less or toner of seven colors or more is used can be employed.

(H03) In the above-described embodiments, toner of six colors including G: Green, O: Orange, Y: Yellow, M: Magenta, C: Cyan, and K: Black is used. However, the present invention is not limited thereto. For example, toner of colors other than the above-described six colors can be used by replacing toner of G: Green and O: Orange. In addition, colorless toner for coating the image surface for waterproof or protection or magnetic toner for forming a predetermined shape or array such as magnetic wires having the shape of lines within an image formed on a printing sheet for preventing theft or the like can be used. In addition, an antitheft device detecting a magnetic pulse generated from a magnetic wire, for example, is disclosed in JP 2006-256124 A and the like.

(H04) In the above-described embodiments, the above-described primary transfer rolls T1*g* to T1*k* are disposed so as to face the above-described photosensitive drums Pg to Pk in the primary transfer areas Q3*g* to Q3*k*. However, the present invention is not limited thereto. For example, non-contact type primary transfer corotrons may be disposed by replacing the above-described primary transfer rolls T1*g* to T1*k*. In such a case, by disposing the corresponding unused primary corotrons to be in a non-contact state in advance even when the above-described retracting rolls R1 to R5 are moved to respective separate positions, the advantages of the present invention can be acquired without linking each of the primary transfer corotrons with the movement of the above-described retracting rolls R1 to R5 and the neutralization plate JB.

(H05) In the above-described embodiments, the above-described intermediate transfer belt B and each of the above-described photosensitive drums Pg to Pk are in contact with each other or separated from each other by moving the above-described rolls R1 to R5 and T1*g* to T1*k* between contact positions and separation positions. However, the present invention is not limited thereto. For example, a configuration in which the above-described retracting rolls R1 to R5 are omitted, only the above-described primary transfer rolls T1*g* to T1*m* are moved between a contact position and a separation position, and movement of the above-described intermediate transfer belt B and the movement of the neutralization plate JB are linked with each other by the above-described primary transfer rolls T1*g* to T1*m* is used, the advantages of the present invention can be acquired. In other words, the above-described primary transfer rolls T1*g* to T1*m* can be configured so as to have the function of the above-described retracting rolls R1 to R5.

(H06) In the above-described embodiments, the above-described neutralization plate JB is configured as a non-contact type for the above-described intermediate transfer belt B. However, the present invention is not limited thereto. For example, a conductive nonwoven fabric, a neutralization brush, or the like, replacing the above-described neutralization plate JB, may be configured to be brought into contact with the above-described intermediate transfer belt B. In addition, in this case, it may be configured that a configuration such as the above-described links LN1 to LN4 is arranged, and movement of the intermediate transfer belt B and movement of the conductive nonwoven neutralization brush are linked together. In such a case, the transport resistance of the above-described intermediate transfer belt B or the performance of the neutralization is not changed due to a change in the suppressing force or separation of the conductive nonwoven fabric and the neutralization brush.

(H07) In the above-described Embodiment 1, in order to reduce the generation of tension lines shown in FIG. 10, one or more similar separation-time winding rolls may be disposed in addition to the above-described separation-time winding rolls Rta and Rtb, so that the generation of tension lines is further reduced. In addition, as in the above-described Embodiment 1, it is preferable that a plurality of the above-described separation-time winding rolls Rta and Rtb are disposed in positions in which tension lines can be easily generated, that is, a position in which the free length becomes to long. However, the present invention is not limited thereto. Thus, similarly to the above-described Embodiment 2, in the belt module BM in which a maximum of six-color development can be performed, the above-described separation-time winding roll (Rta and Rtb) may be disposed in only one place depending on the configuration of the apparatus or the like.

(H08) In the above-described Embodiment 1, the winding rolls (Rd, Rt, Rt2, Rt3, R1 to R5, and T1*g* to T1*k*) are preferably disposed such that the segments L1 to L4 shown in FIG. 2 are in the shape of a straight line. However, the present invention is not limited thereto, and the advantage of the invention can be acquired even in the case where the segments L1 to L4 are not in the shape of a straight line.

(H09) In the above-described Embodiment 1, in order to dispose the visible image forming members (UY+GY) and (UK+GK) of colors of YMCK in the horizontal direction as possibly as can be, the segments L1 to L4 are configured to extend in the left-right direction or the inclined direction thereof, and particularly, the above-described first segment L1 is configured to be extend in the horizontal direction. However, the present invention is not limited thereto. For example, in order to dispose the above-described visible image forming members (UY+GY) and (UK+GK) of the above-described colors in the vertical direction as possibly as can be, the segments L1 to L4 may be configured to extend in the up/down direction of the inclined direction. In addition, in this case, it is referable that particularly one first segment L1 described above is configured to extend in the vertical direction.

(H010) In the above-described Embodiment 1, in case where the third retracting roll R3 is moved to the third separation position, the above-described three-color photosensitive drums Py to Pc are simultaneously separated from the above-described intermediate transfer belt B by the above-described link LN3. However, the present invention is not limited thereto. For example, by separately configuring the retracting rolls and the links according to the photosensitive drums Py to Pc of YMC, the above-described three-color photosensitive drums Py to Pc can be configured to be simultaneously separated from the intermediate transfer belt B or can be configured to be individually separated from the intermediate transfer belt B.

(H011) In the above-described embodiments, the extra-color photosensitive drums Pg and Po are disposed on the upstream side of the photosensitive drums Py to Pk of YMCK in the direction of Ya. However, the present invention is not limited thereto. For example, the black photosensitive drum Pk can be disposed on the downstream side of the black photosensitive drum Pk in the direction of Ya or can be disposed between the photosensitive drums Py to Pk of YMCK. For example, only the orange-color photosensitive drum Po can be disposed on the downstream side of the black photosensitive drum Pk in the direction of Ya.

(H012) In the above-described Embodiment 1, a total of 14 patterns shown in FIG. 5 is implemented, which includes a case where all the six colors of "GOYMCK" are used, a case where five colors of "GYMCK" or "OYMCK" are used, a case where four colors of "YMCK", "GYMC", or "OYMC" are used, a case where three colors of "YMC" are used, a case where two colors of "GO", "GK", or "OK" are used, a case where one color of "G", "O", or "K" is used, and a case of "NONE", that is, a case where any one color is not used. However, the present invention is not limited thereto. For example, two patterns including a case where five colors of "GOYMC" are used and a case where three colors of "GOK" are used can be added.

(H013) In the above-described Embodiment 1, the third angle γ shown in FIG. 2 may be set to zero. In other words, it can be configured that the green photosensitive drum Pg is disposed in an extended line of the second segment L2, and the extra-color photosensitive drums Pg and Po are disposed on the same line.

What is claimed is:

1. An intermediate transfer unit comprising:

an endless belt-type intermediate transfer body whose outside surface passes, along a rotation direction thereof, through an opposing area where the intermediate transfer body is opposed to a first image carrier and a plurality of second image carriers which are arranged on a downstream side of the first image carrier in the rotation direction and which are arranged in a line substantially linearly;

a first moving member that is disposed on a rear side of the intermediate transfer body and on an upstream side of the first image carrier in the rotation direction, the first moving member being configured to be movable between a first position and a second position which is further away from the first carrier than the first position;

a second moving member that is disposed on the rear side of the intermediate transfer body and between the first image carrier and one of the second image carriers which is disposed most-upstream in the rotation direction among the second image carriers, the second moving member being configured to be movable between a third position and a fourth position which is further away from the one of the second image carriers than the third position;

a third moving member that is disposed on the rear side of the intermediate transfer body and between the first image carrier and another one of the second image carriers which is disposed most-downstream in the rotation direction among the second image carriers, wherein the third moving member is configured to be movable between a fifth position and a sixth position which is further away from said another one of the second image carriers than the fifth position, and a first line connecting the second moving member located in the third position and the third moving member located in the fifth moving position is inclined with respect to a line connecting the first moving member located in the first position and the second moving member located in the third position;

a first movement controller, wherein when the first image carrier is used, the first movement controller moves the first moving member to the first position, and when the first image carrier is not used, the first movement controller moves the first moving member to the second position;

a third movement controller, wherein when the second image carriers are used, the third movement controller moves the third moving member to the fifth position, and when the second image carriers are not used, the third movement controller moves the third moving member to the sixth position; and a second movement controller, wherein when any of the first and second image carriers is used, the second movement controller moves the second moving member to the third position, and when the first and second image carriers are not used, the second movement controller moves the second moving member to the fourth position.

2. The intermediate transfer unit according to claim 1, further comprising:

a fourth moving member; and a fourth movement controller, wherein the first image carrier includes an extra-color image carrier that carries an image of a predetermined extra color, the second image carriers include three primary-color image carriers that carry images of three primary colors, respectively, and a black image carrier that carries a black image, the fourth moving member is disposed on the rear side of the intermediate transfer body and between (i) the primary-color image carriers and the black image carrier, the fourth moving member is configured to be movable between a seventh position in which the fourth moving member applies an tension force to the intermediate transfer body and an eighth position which is further away from the intermediate transfer body than the seventh position, the second moving member located in the third position, the fourth moving member located in the seventh position and the third moving member located in the fifth position are arranged in line substantially linearly, when any of the extra-color image carrier and the primary-color image carriers is used, the second movement controller moves the second moving member to the third position, when the extra-color image carrier and the primary-color image carriers are not used, the second movement controller moves the second moving member to the fourth position, when the black image carrier is used, the third movement controller moves the third moving member to the fifth position, when the black image carrier is not used, the third movement controller moves the third moving member to the sixth position, when any of the primary-color image carriers and the black image carrier is used, the fourth movement controller moves the fourth moving member to the seventh position, and when the primary-color image carriers and the black image carrier are not used, the fourth movement controller moves the fourth moving member to the eighth position.

3. The intermediate transfer unit according to claim 2, wherein when the second moving member is moved to the fourth position, the intermediate transfer body is separate from all of the primary-color image carriers.

4. The intermediate transfer unit according to claim 3, further comprising:

a fifth moving member, wherein the extra-color image carrier includes a first extra-color image carrier that carries an image of a first extra color, and a second extra-color image carrier that is disposed on a downstream side of the first extra-color image carrier in the rotation direction and that carries an image of a second extra color, when the first moving member is located in the first position, the first moving member applies a tension force to the intermediate transfer body, the fifth moving member is disposed to correspond to the second extra-color image carrier, the fifth moving member is configured to be movable between a ninth position in which the fifth moving applies a tension force to the intermediate transfer body and a tenth position which is further away from the intermediate transfer body than the ninth position the first movement controller includes first and second movement sub-controllers, when the first extra-color image carrier is used, the first movement sub-controller moves the first moving member to the first position, when the first extra-color image carrier is not used, the first movement sub-controller moves the first moving member to the second position, when the second extra-color image carrier is used, the second movement sub-controller moves the fifth moving member to the ninth position, and when the second extra-color image carrier is not used, the second movement sub-controller moves the fifth moving member to the tenth position.

5. The intermediate transfer unit according to claim 4, further comprising:

a first tension-force applying member that is disposed on an upstream side of the first moving member in the rotation direction and that applies a tension force to the intermediate transfer body;

a second tension-force applying member that is disposed on a downstream side of the third moving member in the rotation direction and that applies a tension force to the intermediate transfer body; and a third tension-force applying member that is disposed between the first moving member and the fifth moving member and that applies a tension force to the intermediate transfer body, wherein a second line connects the third tension-force applying member and the second moving member located in the third position, a third line connects the third moving member located in the fifth position and the second tension-force applying member, a fourth line connects the first tension-force applying member and the third tension-force applying member, and the second, third and fourth lines are inclined with respect to the first line connecting the second moving member located in the third position and the third moving member located in the fifth moving position.

6. The intermediate transfer unit according to claim 2, further comprising:

a fifth moving member, wherein the extra-color image carrier includes a first extra-color image carrier that carries an image of a first extra color, and a second extra-color image carrier that is disposed on a downstream side of the first extra-color image carrier in the rotation direction and that carries an image of a second extra color, when the first moving member is located in the first position, the first moving member applies a tension force to the intermediate transfer body, the fifth moving member is disposed to correspond to the second extra-color image carrier, the fifth moving member is configured to be movable between a ninth position in which the fifth moving applies a tension force to the intermediate transfer body and a tenth position which is further away from the intermediate transfer body than the ninth position the first movement controller includes first and second movement sub-controllers, when the first extra-color image carrier is used, the first movement sub-controller moves the first moving member to the first position, when the first extra-color image carrier is not used, the first movement sub-controller moves the first moving member to the second position, when the second extra-color image carrier is used, the second movement sub-controller moves the fifth moving member to the ninth position, and when the second extra-color image carrier is not used, the second movement sub-controller moves the fifth moving member to the tenth position.

7. The intermediate transfer unit according to claim 6, further comprising:

a first tension-force applying member that is disposed on an upstream side of the first moving member in the rotation direction and that applies a tension force to the intermediate transfer body;

a second tension-force applying member that is disposed on a downstream side of the third moving member in the rotation direction and that applies a tension force to the intermediate transfer body; and a third tension-force applying member that is disposed between the first moving member and the fifth moving member and that applies a tension force to the intermediate transfer body, wherein a second line connects the third tension-force applying member and the second moving member located in the third position, a third line connects the third moving member located in the fifth position and the second tension-force applying member, a fourth line connects the first tension-force applying member and the third tension-force applying member, and the second, third and fourth lines are inclined with respect to the first line connecting the second moving member located in the third position and the third moving member located in the fifth moving position.

8. A transfer device comprising:

the intermediate transfer unit according to claim 1, wherein the outside surface of the endless belt-type intermediate transfer body is opposed to an extra-color image carrier that carries an image of a predetermined extra color, a three primary-color image carriers that carry images of primary colors, respectively; and a black image carrier that carries a black image, and the extra-color image, the images of the primary colors and the black image are transferred onto the outside surface of the intermediate transfer body; and a final transfer member that transfers the images, which were transferred onto the outside surface of the intermediate transfer body, to a final transfer body.

9. An image forming apparatus comprising:

an extra-color image carrier, wherein a latent image for an extra-color image is formed on a surface of the extra-color image carrier;

three primary-color image carriers, wherein latent images for primary colors are formed on surfaces of the three primary-color image carriers, respectively;

a black image carrier, wherein a latent image for a black image is formed on a surface of the black image carrier;

a plurality of developing devices that develop the latent images formed on the extra-color image carrier, the primary-color image carriers and the black image carrier, respectively, to form visible images;

the transfer device according to claim 8, wherein the transfer device transfers onto a medium the visible images formed on the extra-color image carrier, the primary-color image carriers and the black image carrier; and a fixing device that fixes the transferred images on the medium.

* * * * *